United States Patent [19]

Masuda

[11] 4,414,603

[45] Nov. 8, 1983

[54] PARTICLE CHARGING APPARATUS

[76] Inventor: Senichi Masuda, No. 605, Nishigahara 1-40-10, Kita-Ku, Tokyo-to, Japan

[21] Appl. No.: 246,397

[22] Filed: Mar. 23, 1981

[30] Foreign Application Priority Data

Mar. 27, 1980 [JP] Japan ..... 55-39559
Sep. 8, 1980 [JP] Japan ..... 55-124401
Sep. 22, 1980 [JP] Japan ..... 55-132112

[51] Int. Cl.[3] ..... H05B 5/02

[52] U.S. Cl. ..... 361/227; 361/226; 361/135

[58] Field of Search ..... 361/226, 227, 229, 235; 363/34

[56] References Cited

U.S. PATENT DOCUMENTS 4,210,949 7/1980 Masuda ..... 361/227 X

FOREIGN PATENT DOCUMENTS 2838688 3/1979 Fed. Rep. of Germany ..... 361/226

OTHER PUBLICATIONS

"A Pulse Voltage Source for Electrostatic Precipitators"; Masuda, Obata, Hirai; Oct. 1-5, 1978; IEE-IAS 1978; pp. 23-30.

"Boxer-Charger-A Novel Charging Device for High Resistivity Powders"; Masuda et al.; Oct. 1-5, 1978, IEE-IAS 1978; pp. 16-22.

*Primary Examiner*—Reinhard J. Eisenzopf

*Attorney, Agent, or Firm*—Price, Heneveld, Huizenga & Cooper

[57] ABSTRACT

A particle charging apparatus (Boxer-Charger) is constructed by disposing electrode assemblies each consisting of corona discharge electrodes and excitation electrodes, in parallel to each other with a charging space interposed therebetween. An a.c. voltage is applied between the corona discharge electrodes in the respective assemblies to establish a main electric field in the charging space. When the a.c. main voltage has entered a half cycle of particular polarity such as, for example, negative polarity, an excitation high frequency voltage including fast-rising pulses having a pulse duration time of 1 ns−1 ms is applied between the corona discharge electrodes and the excitation electrodes in the assembly to generate a creeping streamer on the corona electrode surface and thereby form a two-dimensional plasma source. Only negative ions are drawn out from this ion source by the action of the main electric field, and these negative ions will travel through the charging space towards the assembly on the opposite side. In the next half cycle, the assembly on the opposite side emits negative ions in the opposite direction. Accordingly, dust particles passing through the charging space are charged as they are bombarded by the negative ions alternately from the opposite directions. If the phases of the main voltage and the excitation voltage are shifted by one-half cycle relative to each other, then charging by positive ions can be achieved.

13 Claims, 24 Drawing Figures

PARTICLE CHARGING APPARATUS

Figure 1:
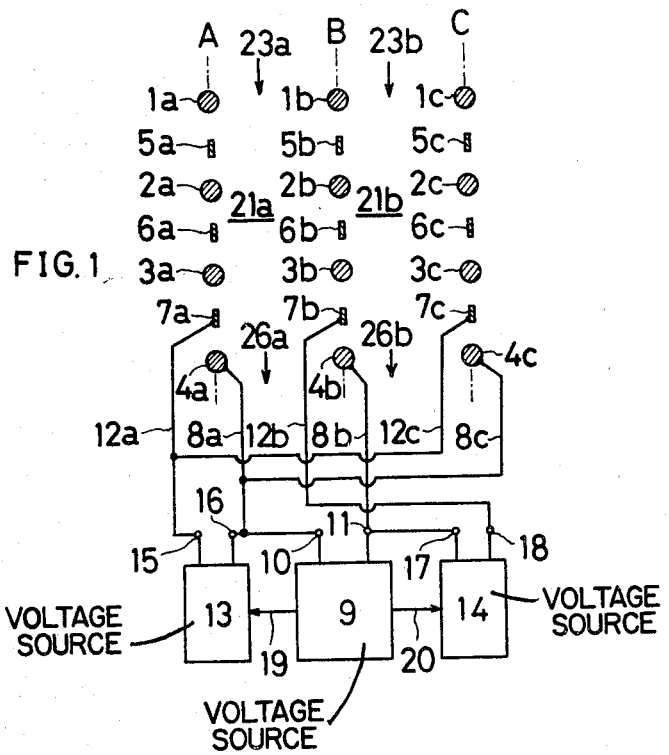

The present invention relates to improvements in a particle charging apparatus (Boxer-Charger) for quickly and effectively imparting electric charge to particles in an electrostatic powder painting system, an electric dust collecting system and other various systems making use of charged powder material.

Heretofore, general particle charging apparatuses in which a D.C. corona discharge is produced from a discharge electrode towards an opposite electrode placed in opposition thereto and charging is effected by passing particles through the electric field, had a shortcoming that particles having a large amount of electric charge are made to adhere to the opposite electrode by a Coulomb's force in the electric field, and hence a charging efficiency is greatly lowered. In addition, in the case where an electric resistance of particles is extremely high, breakdown would be caused by accumulated electric charge in the adhered and piled dust layer, hence back discharge is generated from the breakdown point and neutralizes the charge on the ions and particles of the normal polarity, and this was also a cause of lowering of a charging efficiency.

As a solution for this problem, the inventor of this invention proposed in a separate invention entitled "Particle Charging Apparatus" (Japanese Patent Appln. No. 52-106400 and Japanese Patent Appln. No. 52-150937, U.S. Pat. No. 4,210,949) the so-called "bidirectional monopolar charging system", in which within an alternating electric field, monopolar ions are selectively fed from opposite end electrodes as synchronized with the electric field to make said monopolar ions strike against particles alternately from the opposite directions and thereby charge the particles, and a charging apparatus according to this system was named "Boxer-Charger".

While the above-referred Boxer-Charger is an apparatus having an excellent performance which can entirely resolve many problems associated with the particle charging apparatuses in the prior art, during the course of the inventor's repeating research and development as well as experiments therefor on the Boxer-Charger still further, it has been confirmed that in the case where a certain type of pulse voltage is used as an excitation voltage for generating corona in the Boxer-Charger, spark discharge would not occur even if the interval between the electrodes taking part in the corona discharge is made small, and also that an extremely favorable influence is given to the generation of corona by making use of fast-rising pulses. Also, it has been proved that these merits can be utilized in many types of Boxer-Chargers which have been heretofore developed.

One object of the present invention is to feed a particular pulse voltage to the aforementioned Boxer-Chargers while reserving the merits of the respective types of Boxer-Chargers.

Another object of the present invention is to greatly increase an amount of charge on a charged particle by widely enhancing an intensity of a main electric field established in a charging space up to its critical value.

Still another object of the present invention is to provide special electrodes for producing plasma consisting of ions of both positive and negative polarities alternately on electrode groups provided on the opposite sides of a charging space and for favorably drawing out monopolar ions from the plasma to the charging space.

Yet another object of the present invention is to provide a device which can favorably insulate an electrode adapted to be applied with a fast-rising pulse voltage from another electrode or conductor.

A still further object of the present invention is to provide a power supply apparatus for generating a fast-rising pulse voltage.

According to the present invention, electrodes to be used for establishing an alternating main electric field and effecting corona discharge in a charging space are provided in multiple interposing said charging space therebetween. Two electrode groups opposed to each other are respectively connected excitation voltage sources for generating corona which selectively effect corona discharge, and also between the opposed electrode groups is connected a main voltage source for establishing an alternating main electric field. The electrode group consists of corona discharge electrodes and non-coronal electrodes, or consists of two sets of corona discharge electrodes for alternately effecting corona discharge. The electrode group generates plasma as excited by the excitation voltage source for generating corona, then monopolar ions of either positive or negative polarity in the plasma are drawn out to the charging space by the main electric field, and particles passing through the charging space are charged by these ions.

The excitation voltage source for generating corona produces a fast-rising pulse voltage having a very short pulse duration time of 1 ns – 1 ms.

Besides the above-mentioned, the present invention provides a number of examples of the best electrodes adapted to be used in the Boxer-Charger, and also provides means for insulating the electrode from other electrodes or conductors. Moreover, the present invention provides a power supply apparatus for the Boxer-Charger, which consists of a main voltage source and excitation voltage sources for generating corona.

Figure 2:
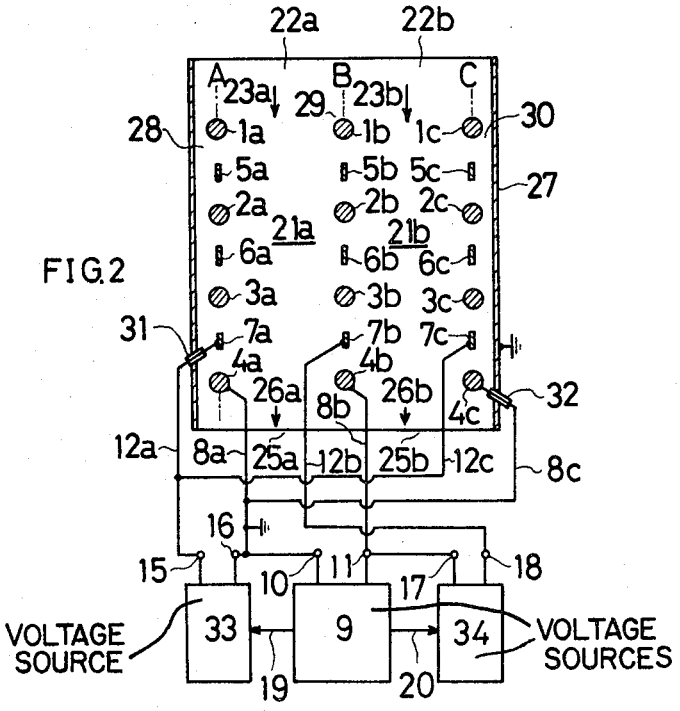
Figure 3:
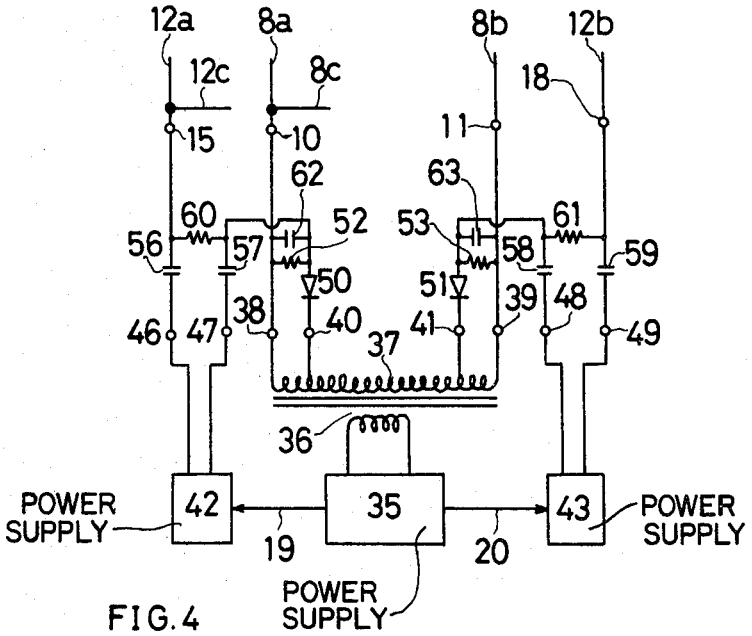
Figure 4:
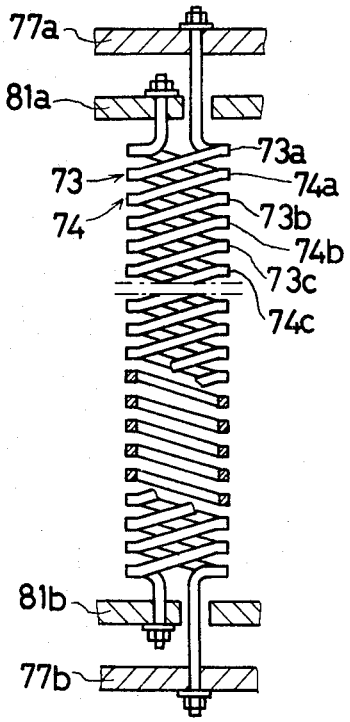
Figure 5:
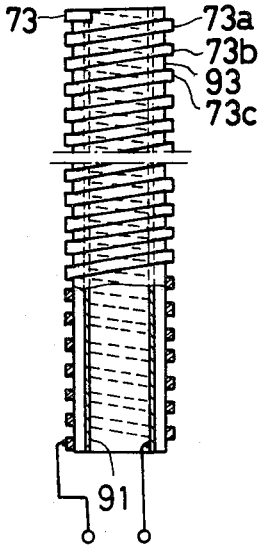
Figure 6:
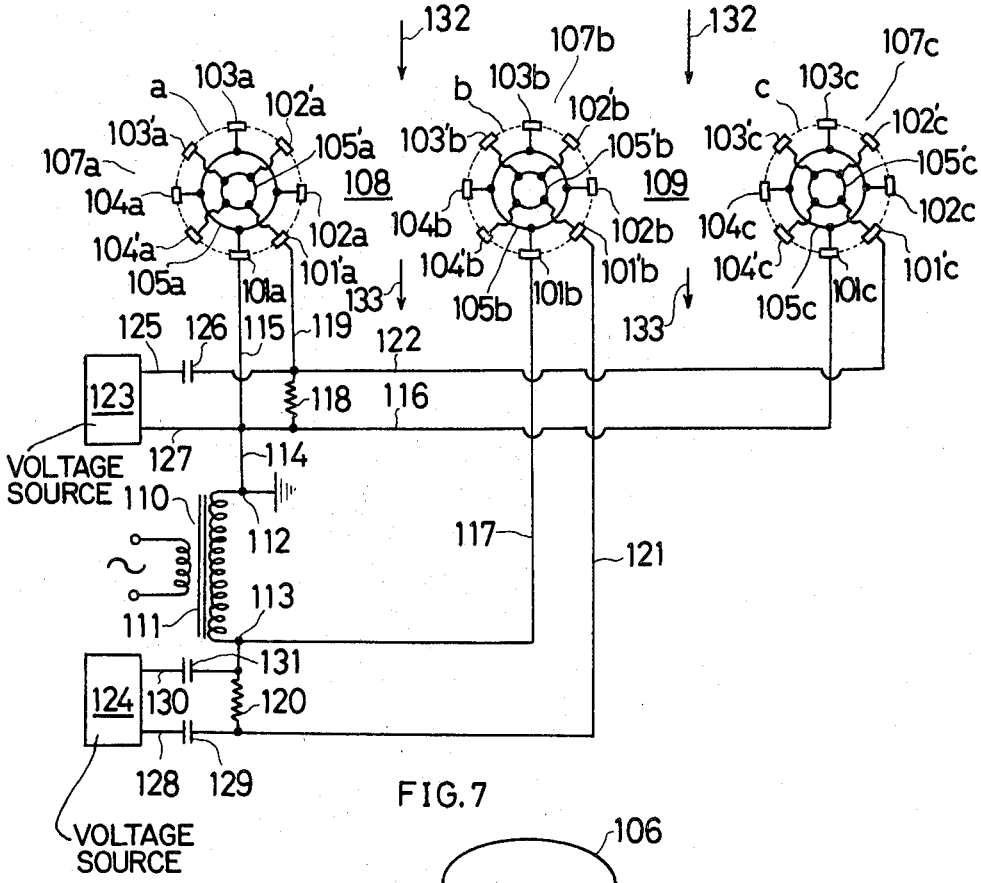
Figure 7:
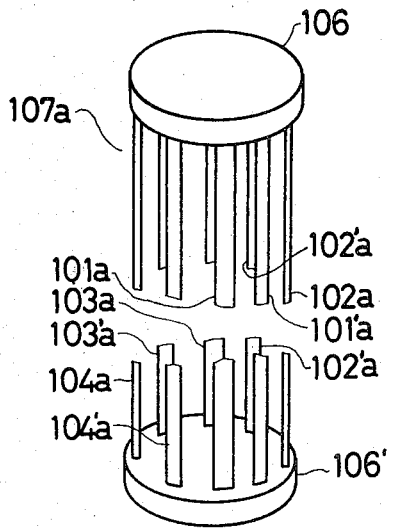
Figure 8:
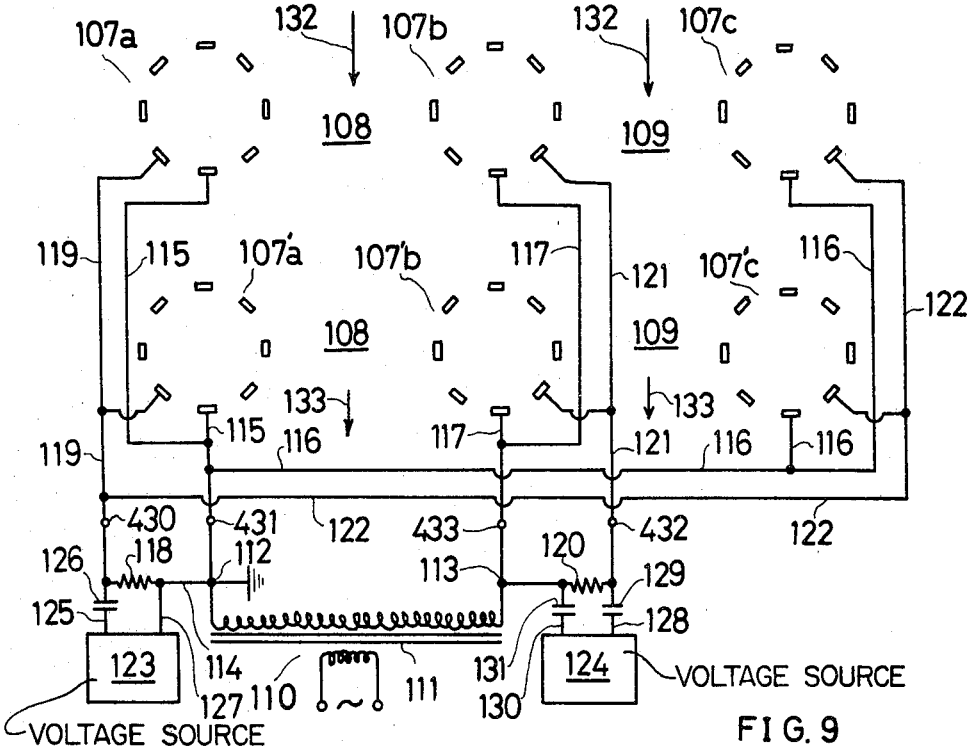
Figure 9:
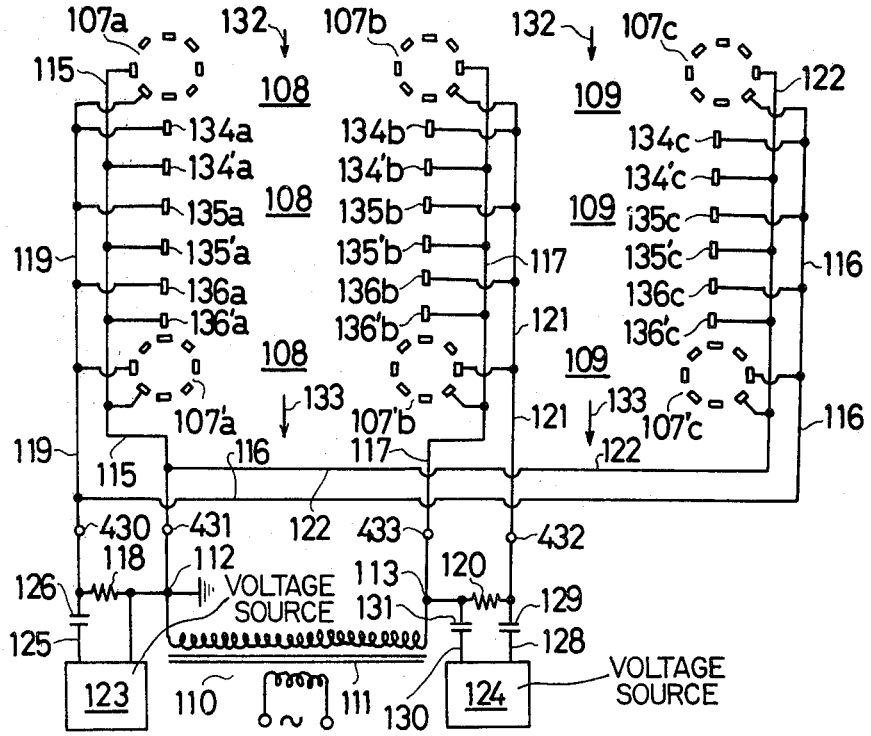
Figure 10:
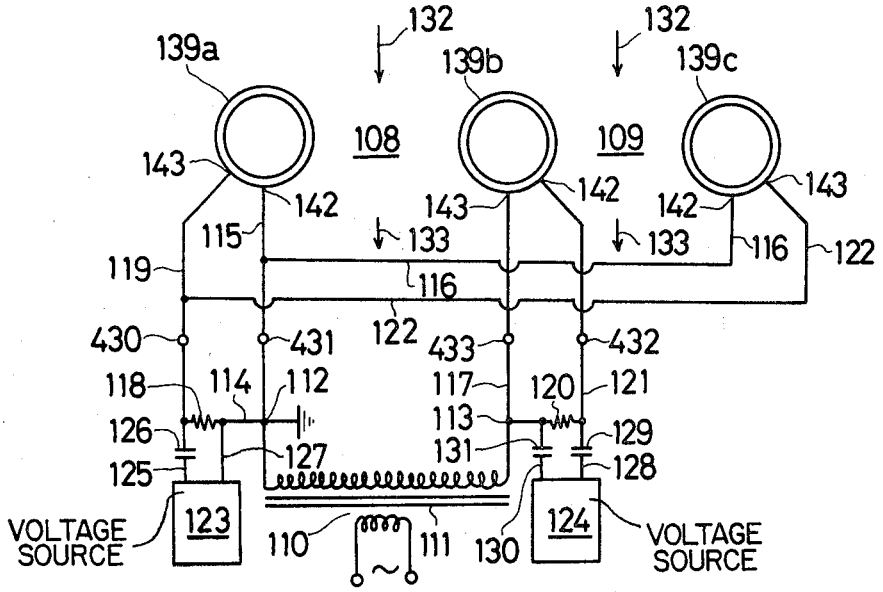
Figure 11:
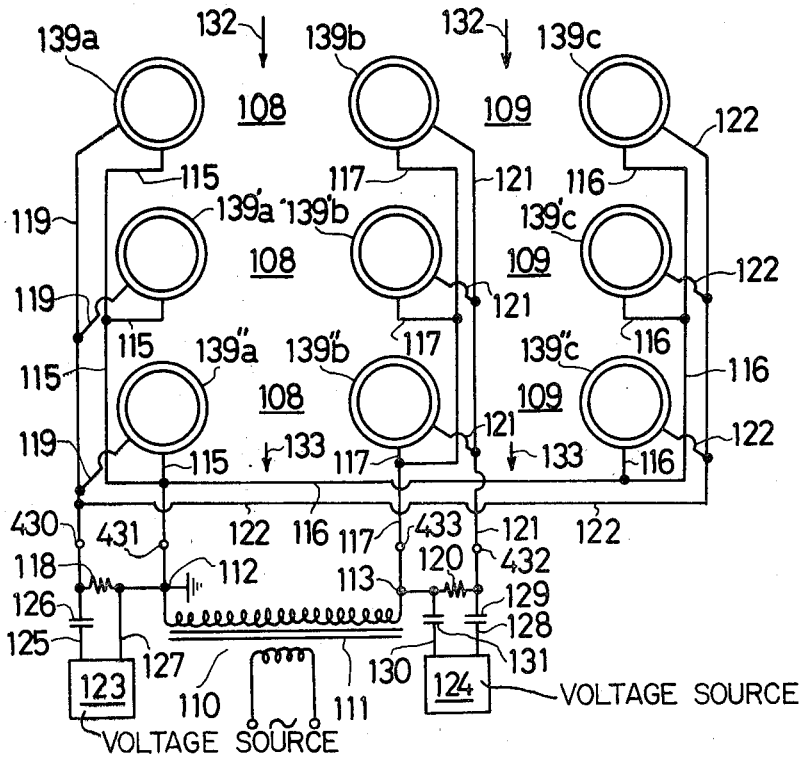
Figure 12:
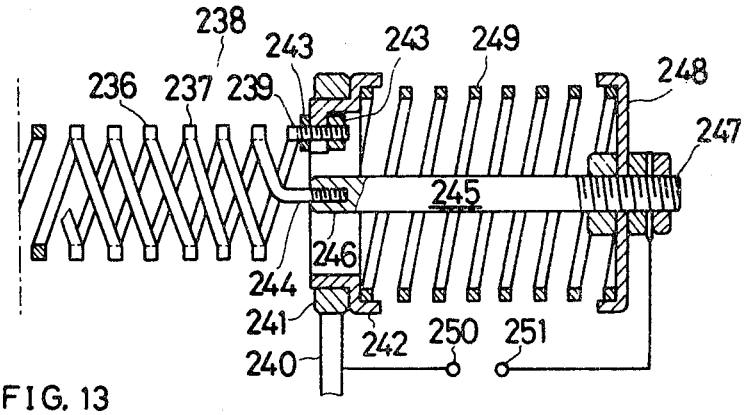
Figure 13:
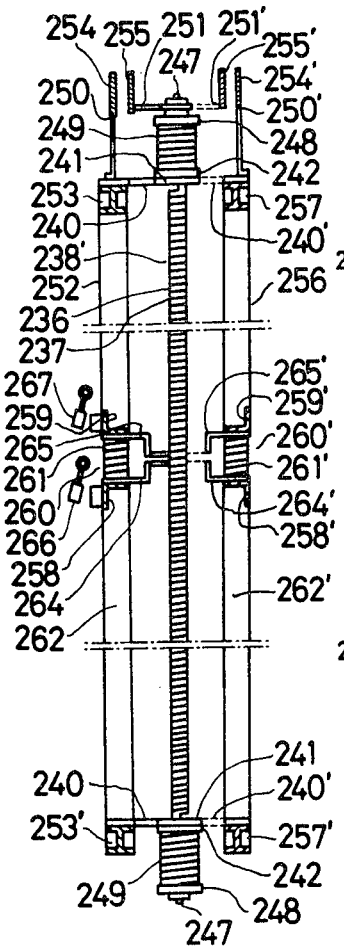
Figure 14:
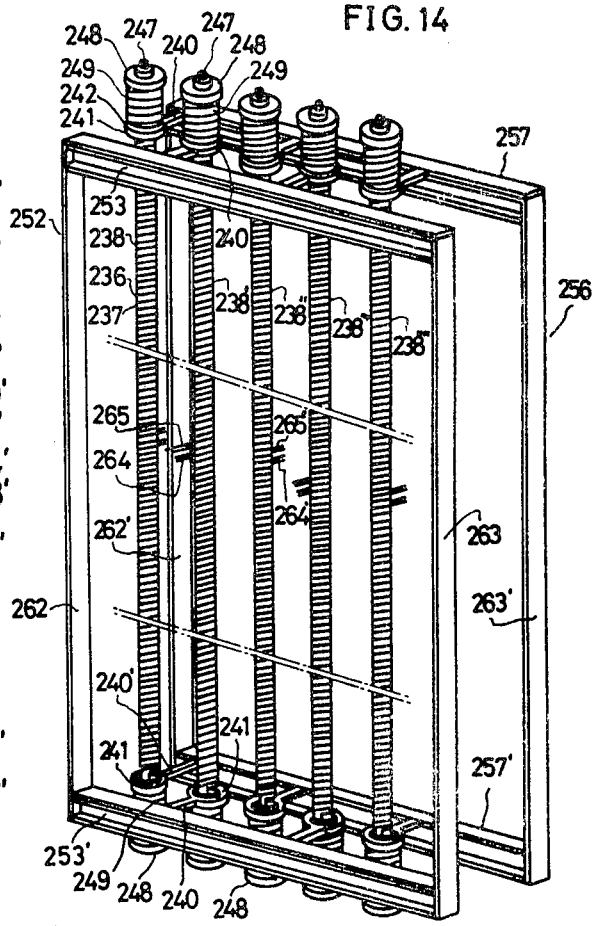
Figure 15:
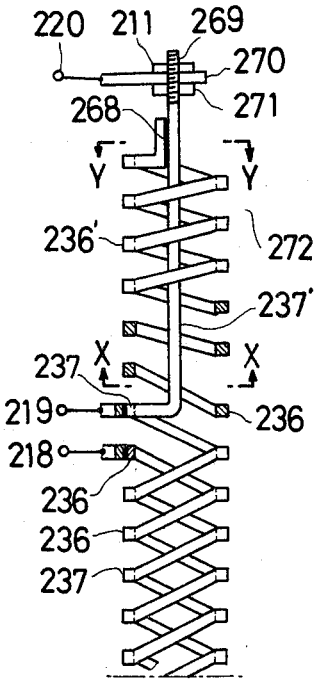
Figure 16:
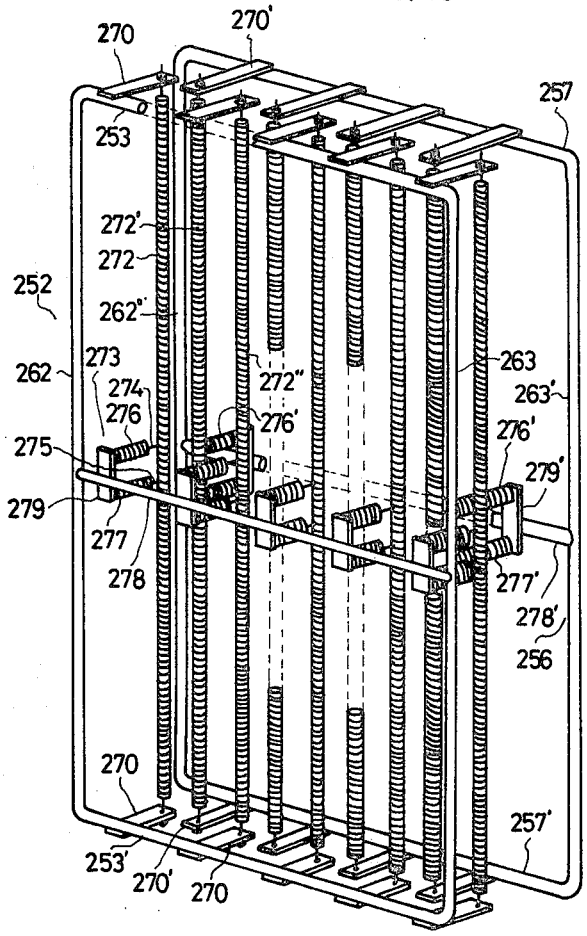
Figure 17:
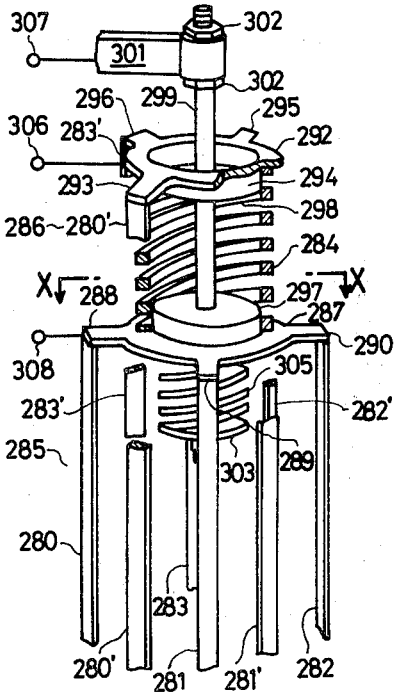
Figure 18:
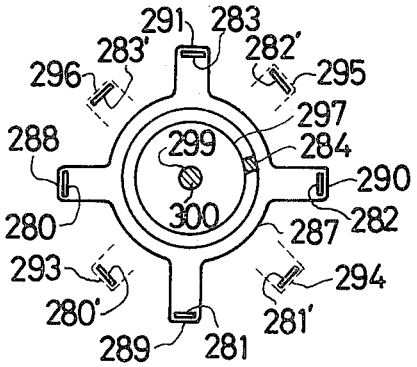
Figure 19:
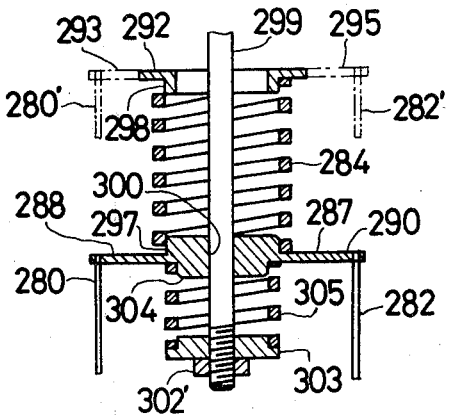
Figure 20:
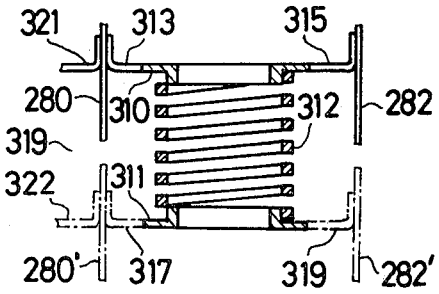
Figure 21:
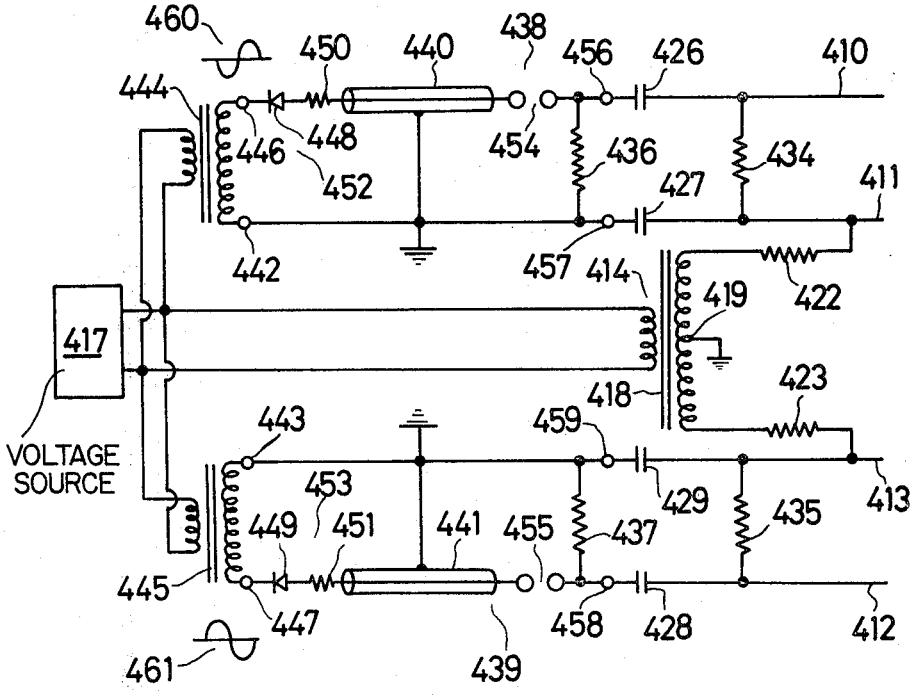
Figure 22:
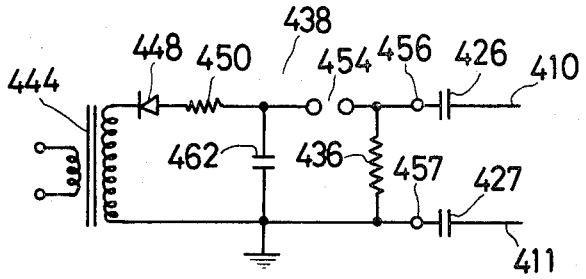
Figure 23:
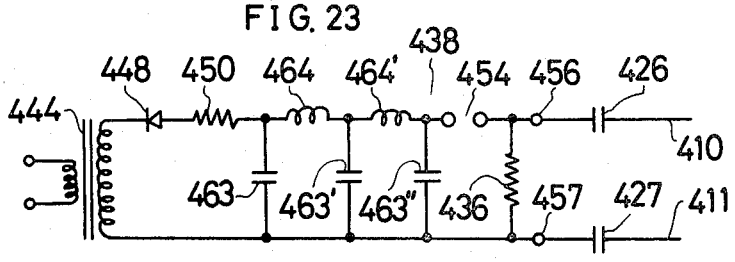
Figure 24:
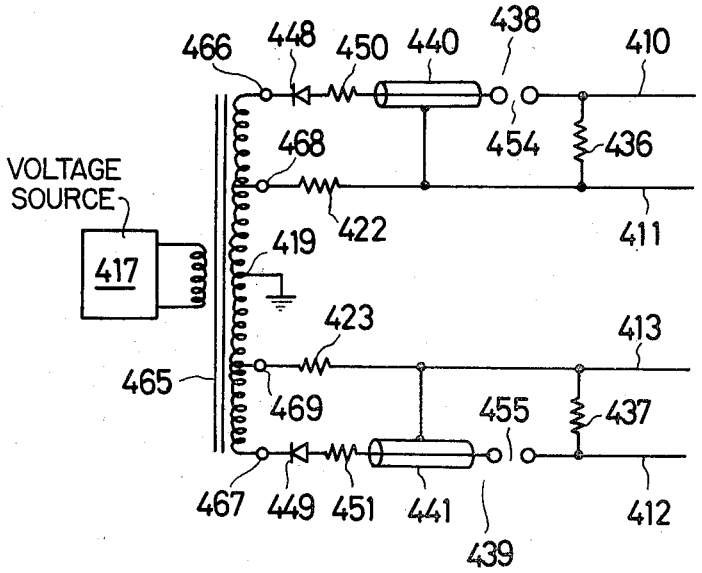

The above-mentioned and other objects and features of the present invention will be better understood from the following description of preferred embodiments of the invention taken in conjunction with the accompanying drawings, wherein:

FIG. 1 is a schematic view showing one example of a basic construction of a particle charging apparatus according to the present invention, FIG. 2 is a schematic view showing another basic construction of a particle charging apparatus according to the present invention, FIG. 3 is a circuit diagram showing one example of a construction of a power supply associated with a bias circuit, FIGS. 4 and 5 are schematic views showing examples of one electrode group to be used in a particle charging apparatus according to the present invention, FIG. 6 is a schematic view showing another example of a particle charging apparatus according to the present invention, FIG. 7 is a perspective view showing details of an electrode assembly illustrated in FIG. 6, FIG. 8 is a schematic view showing a modification of the particle charging apparatus illustrated in FIG. 6, FIG. 9 is a schematic view showing a further modification of the particle charging apparatus illustrated in FIG. 8, FIGS. 10 and 11 are schematic views showing further examples of a particle charging apparatus according to the present invention constructed by making use of the electrode groups illustrated in FIGS. 4 and 5, FIG. 12 is a schematic view showing an electrode group formed by adding insulating means to the electrode group shown in FIGS. 4 and 5, FIGS. 13 and 14 are schematic views showing a Boxer-Charger according to the present invention constructed by making use of the electrode group illustrated in FIG. 12, FIG. 15 shows another electrode group formed by adding insulating means to the electrode group shown in FIGS. 4 and 5, FIG. 16 is a schematic view showing a Boxer-Charger according to the present invention constructed by making use of the electrode group illustrated in FIG. 15, FIG. 17 is a perspective view partly cut away of an electrode group formed by adding insulating means to the electrode group illustrated in FIG. 7, FIG. 18 is a cross-section view taken along line X—X in FIG. 17, FIG. 19 is a longitudinal cross-section view of the upper portion of the electrode group illustrated in FIG. 17, FIG. 20 is a longitudinal cross-section view of the intermediate support in the electrode group illustrated in FIG. 17, FIG. 21 is a circuit diagram showing a power supply apparatus for a Boxer-Charger according to the present invention, FIGS. 22 and 23 are circuit diagrams showing two examples of a pulse generator in the power supply for a Boxer-Charger, and FIG. 24 is a circuit diagram showing another example of a power supply apparatus for a Boxer-Charger according to the present invention.

Referring now to FIG. 1, one example of a construction of a Boxer-Charger in the prior art associated with a pulse voltage source, in which a plurality of two-dimensional electrode assemblies are formed by disposing on a plurality of imaginary surfaces (which need not be always planes but could be curved surfaces) A, B, C, . . . , respectively, non-coronal electrode groups (for instance, cylindrical electrode groups) 1*a*, 2*a*, 3*a*, 4*a*, 1*b*, 2*b*, 3*b*, 4*b*, 1*c*, 2*c*, 3*c*, 4*c*, etc. and corona discharge electrode groups (for instance, wire electrode groups, groups of electrodes of strip shape having sharp opposite edges, groups of electrodes of strip shape with protrusions in each of which a large number of tooth-shaped protrusions are formed on the opposite edges of a strip-shaped metal sheet, thorny rod-shaped electrode groups, etc.) 5*a*, 6*a*, 7*a*, 5*b*, 6*b*, 7*b*, 5*c*, 6*c*, 7*c*, etc. alternately at equal intervals and in parallel to each other as insulated from each other.

As shown in FIG. 1, after the non-coronal electrode groups 1*a*, 2*a*, 3*a*, 4*a*, 1*b*, 2*b*, 3*b*, 4*b*, 1*c*, 2*c*, 3*c*, 4*c*, etc. of the respective two-dimensional electrode assembles belonging to the imaginary surfaces A, B, C, etc. have been connected to respective common lead wires 8*a*, 8*b*, 8*c*, etc., these lead wires 8*a*, 8*b*, 8*c*, etc. are alternately connected to an output terminal 10 or 11 of a main a.c. high voltage source 9 for establishing a main electric field (a sinusoidal wave voltage source, a square wave voltage source and other a.c. high voltage sources having any arbitrary waveforms could be employed, but a square wave voltage source is preferable), and an alternating main electric field is established in the respective spaces 21*a*, 21*b*, etc. between the surfaces A, B, C, etc.

Furthermore, the corona discharge electrode groups 5*a*, 6*a*, 7*a*, 5*b*, 6*b*, 7*b*, 5*c*, 6*c*, 7*c*, etc. of the respective two-dimensional electrode assembies belonging to the respective imaginary surfaces A, B, C, etc. are connected via common lead wires 12*a*, 12*b*, 12*c*, etc. to one 15 or 18 of output terminals 15 and 16, and 17 and 18 of high voltage power supplies serving as the excitation voltage sources 13 and 14 as will be described later. The other terminals 16 and 17 of the above-mentioned power supplies 13 and 14 are connected to the output terminals 10 and 11, respectively, of the main a.c. high voltage source 9. The above-referred pulse power supplies 13 and 14 are power supplies for repeatedly generating high voltage pulses with a very short duration time of 1 ns—1 ms, and in view of the object of the present invention a pulse duration time of 1 ns—1 μs is most preferable.

In the aforementioned construction, when the polarities of the terminals 10 take predetermined ones of positive and negative polarities, for example, when the terminal 10 takes negative polarity and the terminal 11 takes positive polarity, an actuation signal is applied from the main voltage source 9 via a lead wire 19 only to the excitation voltage source 13, so that only the excitation voltage source 13 is actuated to generate high voltage pulses with a very short duration time for excitation of corona between the terminals 15 and 16 (at this moment, since the excitation voltage source 14 is not applied with the actuation signal, an output voltage is not generated between its output terminals 17 and 18.), whereas when the polarity of the main voltage source 9 has been inverted and the terminal 10 has become positive while the terminal 11 has become negative, an actuation signal is applied from the main voltage source 9 via a lead wire 20 only to the excitation voltage source 14, so that only the excitation voltage source 14 is actuated to generate high voltage pulses with a very short duration time between the output terminals 17 and 18 (at this moment, since the excitation voltage source 13 is not applied with the actuation signal, an output voltage is not generated between its output terminals 15 and 16).

Assuming now that when an a.c. main electric field is established in the spaces 21*a* and 21*b* between the imaginary surfaces A, B and C, for instance, with the surfaces A and C held negative and the surface B held positive, the corona discharge electrode groups 5*a*–7*a* and 5*c*–7*c* produce pulsed corona discharge towards the non-coronal electrode groups 1*a*–4*a* and 1*c*–4*c*, and negative ions produced by this corona discharge are withdrawn by the main electric field, then travel across the spaces 21*a* and 21*b* towards the surface B that is held at positive polarity, and are thus absorbed by the electrode groups 1*b*–4*b* and 5*b*–7*b* on the surface B. At this moment, corona discharge would not occur on the surface B, and therefore, supply of ions from the surface B would not be effected.

Subsequently, when the polarity of the a.c. main electric field has been inverted with the surface B held negative and the surfaces A and C held positive, the corona discharge electrode group 5*b*–7*b* on the surface B produces pulsed corona discharge towards the non-coronal electrode group 1*b*–4*b*, and negative ions produced by this corona discharge are withdrawn by the main electric field, then travel across the spaces 21*a* and 21*b* towards the surfaces A and C which are held at positive polarity, and are thus absorbed by the electrode groups 1a–4a, 5a–7a, 1c–4c and 5c–7c on the surfaces A and C. As a result of repetition of the above-described operations, within the spaces 21a and 21b are produced flows of monopolar ions (in the assumed example, negative ions) which flow as alternately changing the direction of flow to the left and to the right in synchronism with the alternating electric field.

Therefore, if particles to be charged are introduced through a particle introduction port into the spaces 21a and 21 along the directions indicated by arrows 23a and 23b, then although the particles are strongly charged by bombardment of the ions from the opposite directions, they fall or they are conveyed along the directions indicated by arrows 26a and 26b through a particle ejection port without adhering to the electrode groups and they are exhausted and supplied to a desired working space, because the charged particles only oscillate to the left and to the right in accordance with the alternation of the main a.c. electric field and are not subjected to unidirectional Coulomb's forces.

As described above, according to the charging system of the present invention, there are provided not only the advantage that even strongly charged particles can be ejected without adhering to the electrode groups and provided in a desired space, but also the advantage that in the case where the excitation voltage sources 13 and 14 are made to generate a repeated pulse voltage having a very short pulse duration time as described above, stable strong corona discharge can be effected without generating spark discharge, even if the electrode intervals are extremely small, and thereby an ion supply capability can be remarkably increased. This means that the electrode intervals can be greatly reduced as compared to the case of the conventional a.c. excitation voltage, and with regard to the electrode structure, insulation between electrodes becomes very easy.

In addition, a remarkable advantage can be provided that as a result of generation of plasma caused by active corona discharge, even if high resistance particles should adhere onto the non-coronal electrode groups and corona discharge electrode groups belonging to the respective surfaces, the accumulated electric charge on these electrode groups would be removed by the positive and negative ions contained in that plasma, and hence generation of back discharge could be also prevented perfectly. Moreover, the aforementioned pulse voltage proceeds as a fast-rising travelling high voltage along the corona electrode and performs multi-reflection, and therefore, an advantage is brought about that corona is produced uniformly (evenly) from every place regardless of a little unevenness in positioning of the corona discharge electrodes and pile-up of dust. There is also provided an advantage that owing to the above-described multi-reflection, the total energy given between the respective electrodes can be efficiently transformed into corona discharge.

Now, it has been both theoretically and experimentally proved that the maximum amount of electric charge possessed by a particle that is attainable according to the above-mentioned system, is proportional to the maximum electric field strength of the main electric field. Therefore, in order to increase the amount of electric charge on a particle it is necessary to raise the field strength of the main electric field. However, if this field strength is excessively raised, the corona discharge electrode groups on the side where the excitation voltage fed from the excitation voltage source 13 or 14 is in pause, which electrode groups essentially should not produce corona discharge, would become to produce corona discharge under the action of the main electric field only, and consequently, ions of opposite polarity (positive ions, in the case of the assumed example shown in FIG. 1) are fed from the discharge electrode groups on the pause side into the spaces 21a and 21b, and neutralize the normal electric charge on the particles charged by the ions (of negative polarity in the example shown in FIG. 1) fed from the corona discharge electrode groups on the side where the electrode groups are just in operation as applied with the excitation voltage, or the ions themselves of the normal polarity. In other words, a critical value Ec of the main electric field strength which would produce the above-described undesirable corona discharge on the corona discharge electrode groups on the pause side, determines the upper limit of the amount of electric charge on a particle. The fact that by generating a fast-rising pulse by means of a pulse voltage having a very small pulse duration time, it becomes possible to produce stable plasma without generating spark discharge even if the distance between the corona discharge electrodes and the non-coronal electrodes is reduced, in itself implies that the amount of electric charge on a particle can be greatly increased by raising the critical value Ec. However, in some cases, in view of design for insulation it is compelled to select the distance between the corona discharge electrode and the non-coronal electrode at a considerably large value. In such cases, if no provision is made, necessarily lowering of the critical value Ec is brought about, and consequently, there arises a problem that the amount of charge on a particle cannot be increased larger than a certain limit.

Another object of the present invention which will be described in the following is to greatly increase the amount of electric charge on a particle in the above described bidirectional monopolar charging system by overcoming the above-described difficulties and by greatly enhancing the aforementioned critical value Ec even if the electrode intervals are made large.

In the preferred embodiment of the present invention illustrated in FIG. 2 and described hereunder, this object can be achieved by the provision that during the period when the polarity of the main voltage of the two-dimensional electrode assemblies belonging to the same surface A, B or C has such polarity with respect to the two-dimensional electrode assemblies belonging to the opposed surface that at least said monopolar ions may not be emitted by the former electrode assemblies (in the illustrated embodiment it is assumed to be positive polarity and hereinafter called "pause polarity"), that is during the main voltage period when at least the excitation voltage is in pause (hereinafter called "pause period"), between the corona discharge electrode groups and non-coronal electrode group of the two-dimensional electrode assemblies belonging to said same surface is applied a d.c. bias voltage with such polarity that the latter has said pause polarity with respect to the former. Thereby, even under a large value of main electric field, the potential of the corona discharge electrodes in the two-dimensional electrode assembly in a pause period is held at an intermediate potential between the non-coronal electrodes in the same electrode assembly and the opposed two-dimensional electrode assembly, so that electric field concentration caused by the main electric field can be suppressed and hence corona discharge can be prevented. Accordingly, the above-mentioned critical value Ec of the electric field can be widely increased, and as a result, in cooperation with the effects of the application of a fast-rising pulse having a very small pulse duration time, remarkable increase of the amount of electric charge on a particle can be achieved.

In the following, the structure and characteristic features of the above-mentioned particle charging apparatus according to the present invention will be explained in greater detail in connection to its preferred embodiments with reference to the accompanying drawings.

In FIG. 2, reference numerals 22*a* and 22*b* designate introduction ports of particles to be charged, reference numeral 27 designates a grounded main body casing made of conductor and connected to the introduction ports 22*a* and 22*b*, numerals 25*a* and 25*b* designate ejection ports of charged particles, and numerals 28, 29 and 30 designate two-dimensional electrode assemblies disposed within the main body casing 27 in parallel to the direction of travelling of the particles and at equal intervals, which electrode assemblies are disposed, in the illustrated example on the three imaginary surfaces A, B and C, respectively. The names and functions of the component parts designated by reference numerals 1 to 26 in FIG. 2 are identical to those of the component parts given like reference numerals in the Boxer-Charger illustrated in FIG. 1. In addition, reference numerals 31 and 32 designate insulator tubes through which lead wires 12*a* and 8*c* penetrate. The lead wires 8*a* and 8*c* are grounded, and thereby the base potential of the two-dimensional electrode assemblies 28 and 30 disposed in the proximity of the wall of the casing 27 is held at zero potential.

In FIG. 2, reference numerals 33 and 34 designate high voltage pulse power supplies which either contain therein or are associated with a bias voltage generator circuit for effecting a biasing action so that it can supply a high pulse voltage including repeated fast-rising pulses having a very short pulse duration time of 1 ns−1 ms as described previously with reference to FIG. 1 and a bias voltage $V_b$ in series with the pulse voltage, and they operate with predetermined period, phase and polarity corresponding to one square wave of an alternating high voltage supplied by a main voltage source 9, in response to actuation signal voltages fed from the main voltage sources 9 through lead wires 19 and 20, respectively. As a result, in the illustrated example, when the respective two-dimensional electrode assemblies 28, 29 and 30 take negative polarity with respect to the opposed two-dimensional electrode assemblies, the corona discharge electrode group belonging to that electrode assembly of negative polarity effects corona discharge towards the non-coronal electrode group in the same electrode assembly in response to the above-mentioned excitation pulse voltage, thereby the corona discharge electrode group emits and supplies negative ions towards the opposed two-dimensional electrode assembly, and as a result, the particles to be charged which have been introduced through inlet ports 22*a* and 22*b* into the spaces 21*a* and 21*b* along the directions indicated by arrows 23*a* and 23*b*, are bombarded and charged by the negative ions in question from the both left and right directions within the alternating electric field, and then ejected through outlet ports 25*a* and 25*b* along the directions indicated by arrows 26*a* and 26*b*.

On the other hand, during the period when the two-dimensional electrode assemblies 28, 29 and 30 take, in the illustrated example, positive polarity with respect to the opposed two-dimensional electrode assemblies, the corona discharge electrode group belonging to that electrode assembly is subjected to the above-described d.c. bias voltage of negative polarity with respect to the non-coronal electrode group in the same electrode assembly, and thus takes an intermediate potential between this d.c. bias voltage and the potential of the opposed two-dimensional electrode group of negative polarity, and therefore, even if the main electric field strength should become very large, the emission of positive ions into the space caused by occurrence of positive corona discharge could be suppressed. Consequently, the aforementioned critical main electric field strength $E_c$ can be made extremely large as compared to the case where the aforementioned bias voltage is not applied, and so, it becomes possible to increase the amount of electric charge that is attainable by a particle.

FIG. 3 shows one example of construction of a power supply apparatus, in which the above-mentioned pulsed excitation voltage source associated with a bias generator circuit is combined with a main voltage source so as to generate desired waveforms. In this figure, reference numeral 35 designates an inverter power supply for generating a main a.c. voltage, which generates a square wave a.c. voltage to generate a square wave a.c. high voltage having the same waveform between terminals 38 and 39 at the opposite ends of a secondary winding 37 of a step-up transformer 36, and applies the same square wave a.c. high voltage via terminals 10 and 11 and lead wires 8*a*, 8*b* and 8*c* between non-coronal electrode groups, for example, in the two-dimensional electrode assemblies 28 and 30 in FIG. 2 and non-coronal electrode group in the two-dimensional electrode assembly 29 in FIG. 2.

The above-referred secondary winding 37 has taps 40 and 41 for generating a bias voltage at the positions of the same turns as counted from the opposite ends of the winding. Reference numerals 42 and 43 designate pulse power supplies for generating repeated pulses having a fast-rising waveform with a very short pulse duration time, which intermittently generate a.c. pulse voltages having a very short pulse duration time in response to actuation signals applied alternately from the main voltage source 35 via lead wires 19 and 20, respectively, and between their output terminals 46 and 47, and 48 and 49 are respectively generated pulsed high voltages for exciting corona having a pulse duration time of 1 ns−1 ms. The terminals 47 and 48 are connected to the taps 40 and 41, respectively, via capacitors 57 and 58 and rectifiers 50 and 51, respectively, and further connected via resistors 52 and 53, respectively, to the terminals 38 and 39, as shown in FIG. 3. Thereby, bias voltages are generated as described in the following.

That is, during the period when the output terminal 38-10 of the main voltage source takes negative polarity with respect to the other terminal 39-11, the tap 40 becomes positive with respect to the terminal 38, hence a current is blocked by the illustrated rectifier 50 and cannot flow through the resistor 52 and no potential difference is produced across the resistor 52. Therefore, the terminal 47 takes the same potential as the terminal 38. On the other hand, an actuation signal is applied from the main voltage source 35 via the lead wire 19 to the voltage source 42, so that the above-described pulse excitation voltage having a very short pulse duration time is applied to the corona discharge electrode groups in the two-dimensional electrode assemblies 28 and 30 connected to the terminal 46-15 via lead wires 12*a* and 12*c*, relative to the non-coronal electrode groups in the same electrode assemblies connected to the terminal 38-10 via lead wires 8*a* and 8*c*, and thereby corona discharge is effected.

However, during this period, the terminal 39 takes positive polarity with respect to the tap 41, and a current flows through the resistor 53 because the rectifier 51 can now conduct, and an electromotive force between the terminal 39 and the tap 41 corresponding to the bias voltage appears across the resistor 53. On the other hand, since an actuation signal is not applied, during this period, from the main voltage source 35 via the lead wire 20 to the voltage source 43 and hence a pulse excitation voltage does not appear between the terminals 48 and 49, after all a negative d.c. bias voltage is applied, during this period, to the corona discharge electrode group in the two-dimensional electrode assembly 29 connected via the lead wire 12*b* to the terminal 49-10 relative to the non-coronal electrode group in the same electrode assembly 29 connected via the lead wire 8*b* to the terminal 39-11, and thereby corona discharge in this electrode assembly 27 can be strongly suppressed.

Subsequently, during the next period when the polarity of the output voltage of the main voltage source is inverted, operations opposite those described above are carried out, so that a negative d.c. bias voltage is applied to the corona discharge electrode groups in the two-dimensional electrode assemblies 28 and 30 relative to the non-coronal electrode groups in the same electrode assemblies, while a pulse excitation voltage is applied to the corona discharge electrode group in the two-dimensional electrode assembly 29 relative to the non-coronal electrode group in the same electrode assembly, and these operations are repeated further.

Reference numerals 56–59 designate coupling capacitors provided in output circuits for deriving pulsed voltages from terminals 46–49 at positions close to the terminals 46–49, which capacitors function so as to pass the pulse voltages from the pulse excitation voltage sources 42 and 43 but to isolate the pulse voltage sources from a d.c. voltage and the main voltage at a low frequency. In these pulsed voltage output circuits are provided charge-leaking high-resistance resistors 60 and 61 so as to mutually connect output lead wires of the respective voltage sources 42 and 43 via the respective capacitors 56 and 57, and 58 and 59, and thereby accumulation of d.c. electric charge in these coupling capacitors can be prevented. In addition, coupling capacitors 62 and 63 for passing pulsed voltages similarly to the above-described capacitors 56–59 are provided in parallel to and in the proximity of the resistors 52 and 53, respectively.

In the above-described feature of the present invention, while the period of application of the above-described d.c. bias voltage should be necessarily equal to at least the pause period of the corresponding two-dimensional electrode assembly as described above, in some cases it could be longer than the pause period and also it could include the corona discharge period when the pulse excitation voltage is applied. In addition, the pulse excitation voltage source incorporated with the biasing action could be constructed of any appropriate component parts and circuitries. Moreover, although the waveform of the main voltage supplied by the main a.c. high voltage source could be a sinusoidal wave, square wave or any other a.c. waveform, employment of a square wave alternating voltage is most preferable for the purpose of enhancement of a charging efficiency. As the above-mentioned pulse voltage for generating corona, a pulse voltage including a fast-rising pulse having a very short pulse duration time of 1 ns – 1 ms is employed, but preferably a pulse duration time of 1 ns – 1 μs should be selected. It is to be noted that in the case of a pulse voltage having a pulse duration time exceeding the range of 1 ns – 1 ms, the expected effects and advantages of the present invention cannot be achieved.

While examples employing two-dimensional electrode assemblies as electrode assemblies have been disclosed above in connection to the preferred embodiments illustrated in FIGS. 1 to 3, if the electric field should be further increased for enhancing a charging efficiency, there is produced an edge effect that field concentration would occur at the edge portions of the electrode assemblies having the above-described two-dimensional arrays with an electric field established therebetween. Consequently, if it is tried to increase the amount of charge on a particle by enhancing an electric field strength of the above-described alternating electric field, discharge would also occur at the edge portions of the electrode assemblies on the side where plasma is not excited, so that ions having the opposite polarity to the normal polarity of the ions originally supplied from the plasma are emitted from the discharge portion, resulting in neutralization of the charge on a particle, and therefore, the upper limit of the amount of electric charge is liable to be suppressed.

In the modified embodiments shown in FIGS. 4 to 11 are disclosed electrode assemblies in which the configurations of electrode elements are improved so as to obviate the above-described edge effect.

FIG. 4 is an enlarged cross-section view partly omitted showing electrodes which are available in place of the electrode assembly in the Boxer-charger shown in FIGS. 1 and 2. More particularly, in the illustrated embodiment, two spirally formed electrodes 73 and 74 of the same configuration having equal coil diameters, equal coil material cross-sections and equal coil pitches are superposed concentrically with each other so that the adjacent coil pitches may form uniform double herical wires, and thereby they are equalized to the electrode assembly (1*a*, 5*a*, 2*a*, 6*a*, . . . ), (1*b*, 5*b*, 2*b*, 6*b*, . . . ) or (1*c*, 5*c*, 2*c*, 6*c*, . . . ) as referred to previously with reference to FIG. 1. The respective rings forming coil portions 73*a*, 73*b*, 73*c*, . . . and 74*a*, 74*b*, 74*c*, . . . , respectively, correspond to the respective electrode groups 1*a–c*, 2*a–c*, 3*a–c*, . . . and 5*a–c*, 6*a–c*, 7*a–c*, . . .

In this example, the electrodes 73 and 74 are formed as coil springs having predetermined resiliency, and they are disposed in a stretched condition with their upper and lower ends secured to mounts 77*a*, 77*b* and 81*a*, 81*b*, respectively, as insulated from each other. While the cross-section configuration of the electrode element wire was selected, in the illustrated embodiment, to be a substantially square cross-section shape which is considered to be most desirable in view of the object of the present invention, it is also possible to otherwise form it in a circular or rectangular cross-section shape. Furthermore, it is also possible to use either one of the electrodes 73 and 74 as a non-coronal electrode and the other as a corona discharge electrode.

In addition, though not shown in FIG. 4, upon shaping and holding the electrodes 73 and 74 in a coil shape, it is possible that either an insulator tube having an outer diameter equal to the coil inner diameter of the respective electrodes is inserted into the coils or electrode wires are wound around such insulator tube in a double helical form, then the coils and the insulator tube are fixed to each other.

In the illustrated embodiment, the interval between adjacent ones of the rings 73*a*, 73*b*, 73*c*. . . and the rings 74*a*, 74*b*, 74*c*, . . . formed for each pitch of the coils 73 and 74 as described above, is a uniform interval of spiral shape at any location. Moreover, if the coils are formed as springs, by fixing the coils in a stretched condition while applying tension forces to their opposite ends, the uniformity of the electrode interval can be reserved even if the electrodes are subjected to mechanical or thermal deformations, and hence, spacers for reserving the uniformity are, in general, unnecessary. As a result, local concentration of an electric field would not specifically occur between the electrodes 73 and 74, nor it would not occur that on the electrode on the unexcited side is produced corona discharge of opposite polarity and thereby the ions having normal polarity are neutralized.

Furthermore, as a result of the formation of an ion generating section in a coil-shaped construction, as viewed in a cross-section perpendicular to the coil axis it is seen that the edge effect as produced in the case where the electrode assembly has a two-dimensional construction as shown in FIGS. 1 and 2 would not occur. As a result, the undesirable edge-effect corona discharge caused by the alternating main electric field in an unexcited period, can be prefectly eliminated, as so, it becomes possible to set the value of the alternating main electric field at a very high value and thereby widely increase the amount of electric charge on a particle that is proportional to this electric field value.

In the above-described construction, although the problem of edge a.c. corona discharge can be resolved by the above-mentioned method, as the alternating main electric field value is increased successively, it becomes that undesirable corona discharge of the opposite polarity is also generated from the double helical electrodes in an unexcited period by the aforementioned main electric field even in the preferred embodiment shown in FIG. 4, and thus the problem arises that the ions of the opposite polarity emitted from this corona discharge would neutralize the electric charge on the ions of the opposite polarity or on the particles. In order to prevent this difficulty, it is necessary to select the interval between the double helical electrodes at the adjacent portions as small as possible.

However, in this case if the conventional d.c. or a.c. excitation voltage is applied, also the corona discharge becomes unstable, spark occurs readily prior to generation of corona, and it becomes impossible to produce spatially uniform plasma. Whereas, if a repeated pulse high voltage including fast-rising pulses having a very short pulse duration time (1 nano-second—1 micro-second) according to the present invention is used as an excitation voltage, then the spark voltage is widely raised, on the other hand generation of corona or streamer discharge becomes very easy and active, it becomes possible to make the interval between the double helical electrodes extremely small, and thereby it becomes possible to greatly increase the amount of electric charge on a particle by widely raising the main electric field strength.

Such a fast-rising pulse high voltage having a short pulse duration time could be generated through any arbitrary method. The pulse high voltage having a short pulse duration time travels along the double helical electrodes as a travelling wave, and during this travelling, spatially very uniform plasma is produced by generating pulsed corona discharge over the entire lengths of the electrodes. Also it has an advantage that the total energy of the pulse high voltage can be efficiently transformed into corona discharge by being subjected to multiple-replection at the open ends of the electrodes.

FIG. 5 is a partly omitted, enlarged cross-section view of another example of the electrodes according to the present invention. The electrodes having the illustrated structure are also preferable for use as electrodes of the Boxer-Charger shown in FIG. 2. More particularly, in this example, a corona discharge electrode 73 is formed in a wire-shape having various cross-section configuration as is the case with the above-described example shown in FIG. 4, and this electrode wire is fixedly wound around an outer periphery of a tubular body 93 shaped cylindrically and made of insulator such as glass or the like to form a single helix having a uniform pitch. The rings 73*a*, 73*b*, 73*c*, . . . for the respective pitches are made to correspond to the electrodes (5*a*, 6*a*, 7*a*, . . . ), (5*b*, 6*b*, 7*b*, . . . ) or (5*c*, 6*c*, 7*c*, . . . ) in FIG. 2. In addition, on the inner periphery of the tubular body 93 is formed a conductor film 91 as by painting or adhesion of a thin-walled tube, and this conductor film is made to correspond to the non-coronal electrodes (1*a*, 2*a*, 3*a*, . . . ), (1*b*, 2*b*, 3*b*, . . . ) or (1*c*, 2*c*, 3*c*, . . . ) in FIG. 2. Then, by applying a pulse high voltage having a short pulse duration time between the corona discharge electrode 73 and the conductor film 91, corona discharge is produced from the corona discharge electrode 73, and the plasma of the corona discharge serves as an ion supply. In the electrode construction illustrated in FIG. 5 also, a common technical effect can be achieved that the electrode intervals are stabilized, and hence, generation of corona discharge of the opposite polarity on the electrodes in an unexcited period can be prevented.

In another preferred embodiment of the present invention illustrated in FIG. 6, on the side surface of three imaginary cylinders a, b and c imagined on one plane in parallel to each other and at equal intervals, are disposed narrow strip-shaped (elongated rectangular) corona electrodes 101*a*, 101'*a*, 102*a*, 102'*a*, 103*a*, 103'*a*, 104*a*, and 104'*a*; 101*b*, 101'*b*, 102*b*, 102'*b*, 103*b*, 103'*b*, 104*b* and 104'*b*; and 101*c*, 101'*c*, 102*c*, 102'*c*, 103*c*, 103'*c*, 104*c* and 104'*c* in parallel to each other and at equal intervals in the above-described sequence, to be used as electrode elements, which electrodes are alternately connected to loop conductors 105*a* and 105'*a*, 105*b* and 105'*b*, and 105*c* and 105'*c*, respectively, to be grouped into two sets of adjacent electrode elements 101*a*–10-2*a*–103*a*–104*a* and 101'*a*–102'*a*–103'*a*–104'*a*; 101*b*–10-2*b*–103*b*–104*b* and 101'*b*–102'*b*–103'*b*; and 101*c*–10-2*c*–103*c*–104*c* and 101'*c*–102'*c*–103'*c*–104'*c*. These two sets of adjacent electrode elements belonging to the side surfaces of the respective imaginary cylinder side surfaces are held at their upper and lower ends by insulator supports 106 and 106', repectively, as insulated from each other and held in tension as shown in FIG. 7, and thus form three strip electrode type cylindrical electrode assemblies 107*a*, 107*b* and 107*c* belonging to the imaginary cylinders a, b and c, respectively. The electrode assemblies 107*a*, 107*b* and 107*c* are disposed at equal intervals with their center axes placed on one imaginary plane so that the adjacent assemblies may be insulated from each other, to form one Boxer-Charger, and they establish charging spaces 108 and 109 therebetween. A structure of one of the electrode assemblies 107*a* is illustrated in a perspective view in FIG. 7.

In FIG. 6, reference numeral 110 designates a main a.c. high voltage source cnsisting of a step-up transformer 111 having its primary connected to an a.c. power supply, and between its secondary terminals 112 and 113 is generated a main a.c. high voltage. The terminal 112 is grounded, and is connected via lead wires 114, 115 and 116 to the loop conductors 105*a* and 10*c* of the electrode assemblies 107*a* and 107*c*, respectively, and the terminals 113 is connected via a lead wire 117 to the loop conductor 105*b* of the electrode assembly 107*b*. Since the loop conductors 105*a*, 105*b* and 105*c* are respectively connected to the loop conductors 105'*a*, 105'*b* and 105'*c* via a high resistance 118 and lead wires 115 and 119, via a high resistance 120 and lead wires 117 and 121 and via the high resistance 118 and lead wires 116 and 122, respectively, the eight strip-shaped corona discharge electrodes belonging to the respective electrode assemblies 107*a*, 107*b* and 107*c* are normally at the same potential for each electrode assembly. Accordingly, by connecting the main a.c. high voltage source 110 in the above-described manner, the above-referred main a.c. high voltage is applied between adjacent electrode assemblies 107*a*–107*b* and 107*b*–107*c*, and thereby an alternating main electric field is established in the charging spaces 108 and 109 therebetween. Reference numerals 123 and 124 designate excitation voltage sources for selectively exciting corona discharge to form a plasma ion source by applying a pulse high voltage having a short pulse duration time serving as an excitation voltage between the respective two sets of electrode element groups (in the illustrated example, strip-shaped electrode groups) in synchronism with the alternating main electric field when the electrode assemblies 107*a*, 107*b* and 107*c* take particular polarity of the main a.c. voltage, and thereby emitting monopolar ions of the above-described particular polarity into the charging spaces 108 and 109. The output terminals of the excitation voltage source 123 are connected via a lead wire 125, a capacitor 126 and a lead wire 127 to lead wires 122 and 116, respectively, and the output terminals of the excitation voltage source 124 are connected via a lead wire 128, a capacitor 129, a lead wire 130 and a capacitor 131 to lead wires 121 and 117, respectively. The waveform of the excitation voltage could be, besides the above-described pulse waveform, any arbitrary waveform varying at a frequency equal to or higher than the frequency of the main a.c. voltage such as, for example, square waves, sinusoidal waves, pulsating waves, triangular waves, pulse waves, etc. Among other things, an a.c. voltage or a pulse voltage at a high frequency of 10 or more times as high as the frequency of the main a.c. voltage is preferable for pruducing stable plasma, and especially if a fast-rising pulse voltage having a pulse duration time of 1 ns—1 ms is employed, then always the most stable and intense plasma can be formed, and hence the highest charging performance can be attained. Now, if only the exitation voltage source 123 of the exitation voltage sources 123 and 124 is actuated during any period within the half cycle of the main a.c. voltage source 110 when the output terminal 112 takes, for example, negative polarity and the output terminal 113 takes positive polarity, especially when the main a.c. voltage takes the values near to its crest value, then the output excitation voltage of the voltage source 123 is applied between the two sets of electrode elements of the electrode assemblies 107*a* and 107'*a* held at negative polarity, that is, between 101*a*–102*a*–103*a*–104*a* and 101'*a*–102'*a*–103'*a*–104'*a*, and between 101*c*–102*c*–103*c*–104*c* and 101'*c*–102'*c*–103'*c*–104' via lead wires 115 and 119 and loop conductors 105*a* and 105'*a* and via lead wires 115 and 122 and loop conductors 105*c* and 105'*c*, and hence corona discharge is produced from the opposite edges of the respective adjacent electrode elements (strip-shaped corona discharge electrodes) towards each other, resulting in formation of a plasma ion source consisting of positive and negative ions therebetween. In the case of the illustrated embodiment, only negative ions in the plasma are drawn out by the above-mentioned main alternating electric field into the charging spaces 108 and 109, then travel across the charging spaces 108 and 109 towards the electrode assembly 107*b*, and are absorbed by the respective electrode elements 101*b*–102*b*–103*b*–104*b* and 101'*b*–102'*b*–103'*b*–104'*b* of the electrode assembly 107*b* which electrode elements are held at positive polarity of the main a.c. voltage as unexcited. During this half cycle, the other excitation voltage source 124 is in a pause and the electrode assembly 107*b* is not applied with an excitation voltage, so that a plasma ion source is not formed in the electrode assembly 107*b*. Accordingly, so far as the already described edge effect of the main a.c. electric field is not present, positive ions would not be emitted from the electrode assembly 107*b* to the charging spaces 108 and 109. Since such edge effect is not produced in the electrode assembly having the illustrated structure, the crest value of the main a.c. electric field can be raised up to the limit value for suppressing generation of a spark. The reason is because the electrode elements are disposed in each electrode assembly on a side surface of an imaginary tubular body having a cross-section configuration of a curved loop or polygon (an imaginary cylinder in the illustrated embodiment) and therefore there is not a portion where lines of electric force of the main a.c. electric field concentrate excessively, according to the characteristic feature of the present invention. Subsequently, when the polarity of the main a.c. voltage is inverted and now the terminal 113 becomes negative while the terminal 112 becomes positive, the excitation voltage source 123 takes a pause during the inverted half cycle and the plasma ion sources in the electrode assemblies 107*a* and 107*c* disappear. On the other hand, however, if only the excitation voltage source 124 is actuated during any period within that half cycle, especially during the period when the main a.c. voltage takes the values near to its crest value of the opposite polarity to the preceding cycle, then the output voltage of the excitation voltage source 124 is now applied to the two sets of electrode elements 101*b*–102*b*–103*b*–104*b* and 101'*b*–102'*b*–103'*b*–104'*b* of the electrode assembly 107*b* and held at negative polarity via lead wires 117 and 121 and loop conductors 105*b* and 105'*b* to form a plasma ion source therebetween. As a result, only negative ions are drawn out from this plasma ion source into the charging spaces 108 and 109 by the main alternating electric field having its polarity inverted, then travel across the charging spaces 108 and 109 in the directions opposite to those in the last half cycle, and are absorbed by the electrode assemblies 107*a* and 107*c* which are held at positive polarity of the main a.c. voltage as unexcited. In this way, in the charging spaces 108 and 109 are formed currents of monopolar (negative, in the illustrated embodiment) ions which travel while alternately changing the direction of flow to the left and to the right as synchronized with the main alternating electric field, and if particles to be charged are introduced externally into these charging spaces in the direction of arrows 132 as conveyed by a gas flow, then the particles are subjected to bombardment of the monopolar ions alternately from the respective directions, i.e., from the left and right directions, hence they are quickly charged at the same polarity (negative polarity in the illustrated embodiment) up to a high saturation value, and thereafter they are supplied externally in the direction of arrows 133.

In the above-described embodiment, the electrode assemblies 107*a*, 107*b* and 107*c* are disposed in parallel to each other at equal intervals so that their center axes may exist on one imaginary plane to form a Boxer-Charger, and so, this embodiment is suitable for interposing a charging device within a narrow space. In this case, the electrode assemblies 107*a*, 107*b* and 107*c* need not be present on one imaginary plane, but could be disposed so that their center axes may exist on any curved surface, and as a matter of course, they could be disposed with their center axes somewhat deviated from a plane or a curved surface, for instance, in a zig-zag manner. In addition, the electrode assemblies are not always disposed on a single imaginary surface, but they can be disposed on a plurality of overlapped imaginary surfaces as shown in FIG. 8 to increase a stay time of the particles in the charging space and thereby improve the charging performance.

FIG. 8 shows a double layer arrangement in which under the electrode assemblies 107*a*, 107*b* and 107*c* shown in FIGS. 6 and 7 are added exactly the same electrode assemblies 107'*a*, 107'*b* and 107'*c*, and by connecting these additional electrode assemblies 107'*a*, 107'*b* and 107'*c* to the same lead wire pairs 119 and 115, 117 and 121, and 116 and 122, the electrode assemblies are paired into 107*a*–107'*a*, 107*b*–107'*b* and 107*c*–107'*c* so as to have the same potentials, respectively, and to be excited simultaneously to form plasma ion sources. The names and functions of the component parts given reference numerals 108–133 in FIG. 8 are identical to those of the component parts designated by like reference numerals in FIG. 6, and hence, the charging operation as a Boxer-Charger is not different at all from that described in connection to the embodiment shown in FIG. 6. However, it is to be noted that in FIG. 8, for simplicity of illustration the loop conductors 105*a*, 105'*a*, 105*b*, 105'*b*, 105*c* and 105'*c* are omitted from illustration.

FIG. 9 shows another preferred embodiment of the present invention, in which between the respective electrode assemblies in the electrode assembly pairs 107*a*–107'*a*, 107*b*–107'*b* and 107*c*–107'*c*, respectively, shown in FIG. 8 are disposed strip-shaped corona discharge electrodes (134*a*, 134'*a*, 135*a*, 135'*a*, 136*a* and 136'*a*), (134*b*, 134'*b*, 135*b*, 135'*b*, 136*b*, and 136'*b*) and 134*c*, 134'*c*, 135*c*, 135'*c* 136*c* and 136'*c*) to each other and at equal intervals on an imaginary plane including the center axes of the respective electrode assemblies as insulated from each other, the strip-shaped corona discharge electrodes 134*a*, 135*a* and 136*a* are connected to the lead wire 119, while the strip-shaped corona discharge electrodes 134'*a*, 135'*a* and 136'*a* are connected to the lead wire 115 to form a joint electrode assembly integrated with the electrode assemblies 107*a* and 107'*a*, the strip-shaped corona discharge electrodes 134*b*, 135*b* and 136*b* are connected to the lead wire 121, while the strip-shaped corona discharge electrodes 134'*b*, 135'*b* and 136'*b* are connected to the lead wire 117 to form a joint electrode assembly integrated with the electrode assemblies 107*b* and 107'*b*, the strip-shaped corona discharge electrodes 134*c*, 135*c* and 136*c* are connected to the lead wire 116, while the strip-shaped corona discharge electrodes 134'*c*, 135'*c* and 136'*c* are connected to the lead wire 122 to form a joint electrode assembly integrated with the electrode assemblies 107*c* and 107'*c*, and thereby electric field curtains are produced. In FIG. 9, the names and functions of the component parts given reference numerals 108–133 are identical to those of the component parts designated by like reference numerals in FIG. 8. More particularly, in the respective joint electrode assemblies in the above-described embodiment, the portions 134*a*–136'*a*, 134*b*–136'*b* and 134*c*–136'*c* arrayed on a plane also serve as planar plasma ion sources when they are applied with excitation voltages. In this preferred embodiment, however, edge effects which would be otherwise produced along the upper or lower edges of the strip-shaped corona discharge electrodes 134*a* and 136'*a*, 134*b* and 136'*b* and 134*c* and 136'*c*, can be obviated by additionally providing the electrode assembly sections 107*a* and 107'*a*, 107*b* and 107'*b* and 107*c* and 107'*c* each consisting of strip-shaped corona discharge electrodes arrayed on a cylindrical surface as described above which are free from edge effects along their upper and lower edges, and consequently the charging efficiency can be remarkably improved.

FIG. 10 shows still another preferred embodiment of the present invention, in which two corona discharge electrode wires 73 and 74 having a rectangular cross-section shape are helically wound on an imaginary cylindrical surface at equal intervals as shown in FIG. 4 and thereby form double helical electrode assemblies 139*a*, 139*b* and 139*c* according to the present invention. As explained previously in connection to the structural example illustrated in FIG. 4, there helical electrodes 73 and 74 are fixedly secured at their upper and lower ends to mutually insulated supports, and stretched between the supports by making use of their resiliency. Assuming now that an excitation voltage is applied to these helical electrodes 73 and 74 (FIG. 4) via terminal 142 and 143, then a plasma ion source is produced in the gap between the helical electrodes 73 and 74 by corona discharge. The names and functions of the component parts given reference numerals 108–133 in FIG. 10 are identical to those of the component parts designated by like reference numerals in FIG. 6, and lead wires 115 and 119, 117 and 121, and 116 and 122 are respectively connected to the terminals 142 and 143 of the respective helical electrodes in the double helical electrode assemblies 139*a*, 139*b* and 139*c*, respectively. The operations of the above-described apparatus as a Boxer-Charger will be omitted from the description because they are self-explanatory.

FIG. 11 shows another preferred embodiment of the present invention in which the double helical electrode assemblies 139*a*, 139*b* and 139*c* illustrated in FIG. 10 are superposed in three layers to form joint electrode assemblies 139*a*–139'*a*–139''*a*, 139*b*–139'*b*–139''*b* and 139''*a*–139''*b*–139''*c* and thereby a Boxer-Charger is formed. In this figure, the names and functions of the component parts given reference numeral 108–133 are identical to those of the component parts designated by like reference numerals in FIG. 10. The operations of the illustrated apparatus serving as a Boxer-Charger will be also omitted from description, because they are self-explanatory.

In the case where the electrode assemblies illustrated in FIGS. 4, 5 and 7 are used in the Boxer-Charger according to the present invention, a pulse voltage having a very short pulse duration time is applied between the electrode elements. Then the pulse voltage propagates as a travelling wave along the electrode elements, and when the electrode elements are employed as corona discharge electrodes, extremely strong streamer corona discharge as compared to the conventional d.c. corona discharge is generated stably along the electrode elements. However, if it is intended to use such electrode elements for a long period of time under a severe environmental condition such as under high temperature, high humidity and coexistence with a dust-containing gas as is the case with a dust collecting system, the insulative support for these electrode elements becomes very difficult, so that not only a lot of expense is necessitated for the insulator members, but also accidents would arise frequently in the insulation per se, and consequently, utilization of a pulse voltage having a short pulse duration time under such environmental condition is greatly limited.

In the preferred embodiments illustrated in FIGS. 12 to 20, a novel electrode assembly is disclosed in which an appropriate inductance element is utilized in place of the insulator member for the purpose of insulating the electrode elements.

As is well known, a pulse voltage having a very short pulse duration time contains very high frequency components as will be obvious from a Fourier integral thereof, and therefore, even though the above-described inductance element has its winding formed of a strong thick conductor and its resistance is negligibly small with respect to its d.c. performance, it presents a very large impedance against the pulse voltage having a short pulse duration time, and practically acts as a nearly satisfactory insulator member.

In more particular, since the above-mentioned pulse voltage having a short pulse duration time propagates as a travelling wave along every conductor system such as conductors in the pulse generator device, transmission lines to a load and electrodes forming a load, strictly speaking the inductance element behaves as a distributed parameter circuit for the travelling wave, and so long as the surge impedance of the inductance element is sufficiently larger than the surge impedance of the conductor system, the travelling wave will be reflected by the inductance element with the same polarity, so that the inductance element can be used as an insulative element at least with respect to the pulse voltage having a short pulse duration time. In the following description, to insulate a pulse voltage having a short pulse duration time by means of an inductance element as described above, will be specifically called "inductance insulation".

FIG. 12 shows only a right end portion of one example for practicing the above-described inductance insulation at the opposite ends of a double helical electrode 238 serving as an ion source which is constructed as shown in FIG. 4, in which an electrode assembly adapted to be applied with a pulse voltage having a short pulse duration time is composed of a double helical corona discharge electrode consisting of two coils 236 and 237 wound so as to have the same axis, the same coil diameter and the same pitch and in themselves having resiliency, and a coil spring for inductance insulation as will be described later. The coil electrode 236 is fixedly secured at its opposite ends 239 as by screw engagement 243 to an annular conductor washer 242 fitted in and supported by an annular socket 241 of a conductor support arm 240. In addition, the coil electrode 237 is threadedly secured at its opposite ends 244 to one end 246 of a conductor support rod 245 disposed along its center axis, and the support rod 245 is fixedly secured at its opposite end to the center of a cup-shaped circular washer 248 as tensioned thereby. The washer 248 is fitted around and supported by one end of a coil spring 249 made of an elastic body under a compressed condition, which also serve to achieve inductance insulation and has its opposite end fitted in and supported by the annular conductor washer 242. Owing to the stretching effect of the coil spring 249, the rod 245 is tensioned to the left and right (to the right in the right end portion illustrated in FIG. 12) to hold the electrode distance between the helical corona discharge electrodes 236 and 237 and also to inductance-insulate the respective electrodes from each other. Assuming now that a pulse voltage having a short pulse duration time is applied between terminals 250 and 251, then this voltage propagates leftwards along the helical corona discharge electrodes 236 and 237 as a travelling wave and is reflected at the opposite end. Thus it repeats multiple reflection at the respective ends, and during such repeated propagation, the pulse voltage generates streamer corona discharge uniformly along the gap space between the helical electrodes 236 and 237, resulting in a plasma ion source.

The electrode assembly 238 adapted to be applied with a pulse voltage having a short pulse duration time according to the above-described embodiment of the present invention could be replaced for the electrode assemblies 139*a*–139*c*, 139′*a*–139′*c* and 139″*a*–139″*c* illustrated in FIGS. 10 and 11 to form the Boxer-Charger. However, further details thereof will be omitted from description because they are self-explanatory.

FIGS. 13 and 14 show one preferred embodiment of a Boxer-Charger according to the present invention, which is constructed by disposing a plurality of electrode assemblies 238 adapted to be applied with a short pulse voltage as shown in FIG. 12 in parallel to each other at equal intervals as insulated from each other on one imaginary plane perpendicular to a gas flow within a large-sized duct through which a dust-containing gas passes such as a casing of a large-sized electric dust collector system so as to interrupt the gas flow. In these figures, reference numerals 238, 238′, 238″, 238‴, 238⁗, . . . designate electrode assemblies adapted to be applied with a pulse voltage having a short pulse duration time as shown in FIG. 12, and component parts given reference numerals 236–251 are identical to the component parts designated by like reference numerals in FIG. 12. Electrode assemblies adapted for application of a short pulse voltage 238′, 238‴, . . . for forming one of the plasma ion sources of the Boxer-Charger, are supported and stretched at their upper and lower ends by horizontal beams 253 and 253′ along upper and lower edges of a rectangular support frame 252 which is insulatively disposed within a duct so as to intersect at right angles with a gas flow, via conductor support arms 240. Reference numerals 254 and 255 designate transmission conductors for supplying a short pulse voltage, which are connected to a short pulse high voltage source not shown, and which consist of parallel strip-shaped conductors to which the opposite end terminals 250 and 251 of the electrodes 238', 238''', . . . are connected. Electrode assemblies adapted for application of a short pulse voltage 238, 238'', 238'''', . . . for forming the other plasma ion source of the Boxer-Charger, are respectively supported and stretched at their upper and lower ends by horizontal beams 257 and 257' along upper and lower edges of a support arm 256 which is insulatively disposed in parallel to and in opposition to the support frame 252 and has the same shape as the latter, via conductor support arms 240'. Reference numerals 254' and 255' designate transmission conductors for supplying a short pulse voltage, which are connected to another short pulse high voltage source not shown, and which consist of parallel strip-shaped conductors to which the opposite end terminals 250' and 251' of the electrodes 238, 238'', 238'''' . . . are connected. The conductors 254 and 254' are further connected to an a.c. high voltage source not shown, thereby an a.c. high voltage is applied between the adjacent electrode assemblies adapted for application of a short pulse voltage 238 and 238', 238' and 238'', 238'' and 238'', . . . , and thus an alternating electric field is established therebetween. When the electrode assemblies 238', 238''', . . . take a voltage near to the negative crest value of the applied a.c. high voltage, the corresponding short pulse high voltage source applies a short pulse high voltage between the respective double helical corona discharge electrodes 236 and 237 of the electrode assemblies 238', 238''', . . . via the conductors 254 and 255 to produce plasma in the respective electrode assemblies 238', 238''', . . . , and thereby negative ions are emitted from these electrode assemblies towards the opposed electrode assemblies 238, 238'', 238'''', . . . . Subsequently, when the polarity of the applied a.c. high voltage is inverted and the electrode assemblies 238', 238''', . . . take a voltage near to the negative crest value of the a.c. high voltage, the other short pulse high voltage source applies a short pulse high voltage between the respective double helical corona discharge electrodes 236 and 237 of the electrode assemblies 238, 238'', 238'''', . . . via the conductors 254' and 255' to produce plasma in the respective electrode assemblies 238, 238'', 238'''', . . . ; and thereby negative ions are emitted from these electrode assemblies towards the opposed electrode assemblies 238', 238''', . . . . In this way, the Boxer-Charger is formed, in which dust particles suspended in a gas passing through the spaces between the electrode assemblies 238, 238', 238'', 238''', 238'''', . . . are bombarded by negative ions alternately from the opposite directions and are thereby strongly charged. Reference numerals 258, 259 and 258', 259', respectively, designate horizontal beams for supporting the electrode assemblies adapted for application of a short pulse voltage 238', 238''', . . . and 238, 238'', 238'''', . . . stretched and supported by the support frames 252 and 256, respectively, additionally at their intermediate positions to prevent their vibrations, and also for forming fixed hammer support mechanisms 260 and 260' to peel off dust adhered onto the electrode assemblies by applying mechanical impacts thereto. The upper ones 259 and 259' and the lower ones 258 and 258' of these horizontal beams are mutually coupled via coil spring groups 261 and 261' for inductance insulation, the lower beams 258 and 258' are at their opposite ends fixedly supported by vertical beams 262 and 263 on the opposite sides of the support frames 252 and 256, but the opposite ends of the upper beams 259 and 259' are separated from the vertical beams 262, 263, 262' and 263' with certain gap spaces provided therebetween. Reference numerals 264, 265 and 264', 265' designate crank-shaped conductor support members having one end fixedly secured to the horizontal beams 258, 259 and 258', 259, respectively, and the other ends fixedly secured to the double helical corona discharge electrodes 236 and 237 of the respectively electrode assemblies 238', 238''', . . . and 238, 238'', 238'''', . . . to fixedly support these corona discharge electrodes while inductance-insulating them from each other. Reference numerals 266, 267, 266' and 267' (266' and 267' being omitted from illustration) designate hammering devices disposed insulatively for hammering the horizontal beams 258, 259, 258' and 259', respectively, to apply mechanical impacts to the electrode assemblies 238', 238''', . . . and 238, 238'', 238'''', . . . via the support members 264, 265, 264' and 265' and thereby cause the dust adhered onto the electrode assemblies to fall.

FIG. 15 shows an upper end portion of another preferred embodiment of an electrode assembly adapted for application of a short pulse voltage serving as a plasma ion source according to the present invention, in which the structure of the inductance-insulation section in the preferred embodiment illustrated in FIG. 12 is simplified. More particularly, in place of the coil spring 249 that is also useful for inductance-insulation in the preferred embodiment shown in FIG. 12, the opposite end portions of the helical corona discharge electrode 235 are extended singly without being opposed to the other opposing helical corona discharge electrode 237, the extended helical coil section 236' between planes X—X and Y—Y is in itself utilized as a coil spring for inductance-insulation, the opposing helical corona discharge electrode 237 has its opposite end portions bent to the inside in an L-shape at the positions inside of the plane X—X and then further bent again outwardly in an L-shape at the center of the helix so as to extend along the center axis of the helix to form a support rod section 237', the support rod section 237' is made to extend through the center portion of the coil spring section 236', then on the outside of the support rod section 237' the opposite ends of the coil spring sections 236' is bent to the inside in an L-shape, and after the bent sections have reached the support rod sections 237', they are bent outwardly in an L-shape along the support rod sections 237' and are fixed by welding to the support rod sections 237' at the contact portions 268 therebetween. The support rod sections 237' are fixedly secured at their opposite ends 269 to the upper and lower support arms 270 as by nuts 271 and screws, and thereby the electrode assembly 272 adapted for application of a short pulse voltage according to the illustrated embodiment can be mounted under tension. When a short pulse high voltage is applied between the terminals 218 and 219 or between the terminals 218 and 220, plasma caused by streamer corona discharge is produced between the double helical corona discharge electrodes 236 and 237, and the plasma functions as a ion source similarly to the case of the preferred embodiment illustrated in FIG. 12. It is also similar to the case shown in FIG. 12 that the plasma can be utilized as a plasma ion source for constructing the Boxer-Charger.

FIG. 16 shows one example of construction of the Boxer-Charger having the same structure as the preferred embodiment shown in FIGS. 13 and 14 by employing the electrode assembly 272 adapted for application of a short pulse high voltage illustrated in FIG. 15, which operates as a plasma ion source according to the present invention. Reference numerals 252 and 256 designate rectangular support frames made of pipes, which are disposed in opposition to and in parallel to each other within a duct in perpendicular to a gas flow, support arms 270 and 270' project horizontally from their upper and lower beams 253, 253' and 257, 257', respectively, towards a center plane between the frames in a staggered relation, and electrode assemblies adapted for application of a short pulse voltage 272, 272', 272'', . . . as illustrated in FIG. 15 are alternately mounted in tension on the support frames 252 and 256 as fixedly supported at their upper and lower ends from these support arms 270 and 270' to be disposed on one imaginary plane perpendicular to the gas flow. The operations of the above-described structure as a Boxer-Charger will be omitted from description because they are similar to the case shown in FIG. 14. In this preferred embodiment, support mechanisms 273 and 273' for fixed hammers at the middle portions of the respective electrode assemblies 272, 272', 272'' . . . are different from the support mechanisms 260 and 260' in FIG. 13, in that support arms 274, 275, 274' and 275' are separately and individually projected from the respective double helical corona discharge electrodes 236 and 237' of the respective electrode assemblies 272, 272', 272'', . . . in the direction perpendicular to the planes of the support frames 252 and 256, which support arms are fixedly secured to support coil springs 276, 277, 276' and 277' serving also as inductance-insulation members, and the base portions of these coil springs 276, 277, 276' and 277' are fixedly secured to vertical washers 279 and 279' which are in turn fixedly secured to intermediate horizontal beams 278 and 278' having their opposite ends supported by vertical beams 262, 263 and 262', 263' of the support frames 252 and 256, respectively. Thereby, the helical corona discharge electrodes 236 and 237 of the respective electrode assemblies 272, 272', 272'', . . . are fixedly supported at their middle portions as inductance-insulated, so that the vibrations of these electrodes can be prevented and also can be applied with mechanical impacts via the vertical washers 279 and 279' and the coil springs 276, 277, 276' and 277' by hammering the horizontal beams 278 and 278', and hence, the dust adhered onto these corona discharge electrodes 236 and 237 can be peeled off.

FIG. 17 shows a modification of the electrode assembly shown in FIG. 7 such that inductance-insulation is incorporated. In this figure, a plurality of (in the illustrated example, eight) strip-shaped corona discharge electrodes 280, 281, 282, 283, 280', 281', 282', 283' having a rectangular cross-section are disposed in parallel to each other at equal intervals on an imaginary cylindrical surface along the direction of its generating lines, and alternately divided into two groups each consisting of, in the illustrated example, four electrodes 280–281–282–283 and 280'–281'–282'–283', which electrode sets are supported in tension at their opposite ends as inductance-insulated from each other by means of a coil spring 284 made of resilient conductor, and thereby an electrode assembly 285 adapted for application of a short pulse voltage serving as a plasma ion source according to the present invention, can be constructed. FIG. 18 is a cross-section plan view of a support section 286 including the coil spring 284 at the opposite ends of the electrode assembly taken along line X—X as viewed inwardly, and FIG. 19 is a longitudinal cross-section view of the same section 286 taken along its center axis. The first group of corona discharge electrodes 280–281–282–283 are fixedly supported in tension at their upper and lower ends from four support protrusions 288, 289, 290 and 291, respectively, projecting radially from a periphery of a disc-shaped conductor support washer 287 as angularly spaced by 90° in a cross shape. Outside of the support washers 287, that is, above the upper support washer 287 and under the lower support washer 287 are provided annular support washers 292 coaxially with the support washers 287, and similarly four support protrusions 293, 294, 295 and 296 project radially from the periphery of the support washer 287 as angularly spaced by 90° in a cross shape, at angles of 45° to the above-described protrusions 288, 289, 290 and 291, respectively, so that the second group of corona discharge electrodes 280'–281'–282'–283' may be fixedly supported in tension from these protrusions at their opposite ends. In FIG. 19, for the sake of clarification, the support protrusions 293 and 295 of the annular support washer 292 are depicted by dotted lines as rotated by 45° about their center axis. On the respective support washers 287 and 292 are integrally and coaxially formed circular collars 297 and 298, respectively, having the same radius and projecting towards each other as shown in FIG. 19, and around the outer circumferences of these collars is fitted a coil spring 284 made of resilient conductor and having a smaller outer diameter than the above-described imaginary cylindrical surface on which the corona discharge electrodes are disposed, at its upper and lower ends in a compressed condition for the purpose of inductance-insulation and tensioning support, and thereby the washers 287 and 292 can be supported coaxially with each other as inductance-insulated from each other. Reference numeral 299 designates a support rod slidably penetrating through a hole 300 at the center of the disc-shaped support washer 287 and projecting in the both inner and outer direction perpendicularly to the washer 287, that is, in the upper and lower directions as viewed in FIGS. 17 and 19. On the outside of the washer 287, the support rod 299 extends along the center axis of the coil spring 284 and the annular support washer 292 while penetrating therethrough, and at the outermost ends above and below the electrode assembly, the support rods 299 are fixedly secured to upper and lower support arms 301 by means of screw threads thereon and nuts 302. On the inside of the washer 287, as shown in FIG. 19, the support rod 299 is coupled to the disc-shaped support washer 287 via a washer 303, a collar 304 formed integrally with the washer 287 and a nut 302 threaded thereon by a coil spring 305 held in a compressed condition. Therefore, by strongly drawing the support rod 299 outwardly and then fixedly securing it to the support arm 301, the coil spring 305 is strongly compressed, and thereby the corona discharge electrodes in the first group 280, 281, 282 and 283 can be supported in tension always with a strong tension force via the support washer 287. In addition, at this moment the coil spring 284 is also strongly compressed towards the outside by the washer 287, and thereby the corona discharge electrodes in the second group 280', 281', 282' and 283' also can be supported in tension with a strong tension force via the annular support washer 292. If a short pulse high voltage is applied between the terminals 306 and 307 or between the terminals 306 and 308, then, as a matter of course, strong streamer corona discharge would occur between the corona discharge group 280, 281, 282 and 283 and the other electrode group 280', 281', 282' and 283' to form a plasma ion source.

FIG. 20 shows an intermediate support section 309 which makes use of an inductance element for maintaining mutual distances between the adjacent corona discharge electrodes among the two groups of corona discharge electrodes 280–281–282–283 and 280'–281'–282'–283' at the middle portion of the electrode assembly 285 adapted for application of a short pulse voltage shown in FIG. 17 and also for supporting these corona discharge electrodes to achieve prevention of vibrations and transmission of hammering. In this figure, reference numerals 310 and 311 designate support washers having exactly the same structure as the annular support washer 292 shown in FIGS. 17 and 19, which support washers are coaxially and fixedly coupled one above the other by means of a support coil 312 having a rigid or resilient structure of smaller diameter than the above-described cylindrical surface on which the corona discharge electrodes are disposed and serving as an inductance-insulating member. The tip ends of the four protrusions arrayed in a cross shape of the respective washers 313, 314, 315 and 316, and 317, 318, 319 and 320 are bent outwardly in an L-shape, and are respectively contact-welded to the inside surfaces of the first group of corona discharge electrodes 280, 281, 282 and 283 and the second group of corona discharge electrodes 280', 281', 282' and 283' to support these corona discharge electrodes. It is to be noted that in FIG. 20, for the sake of clarification, the protrusions 317 and 319 of the support washer 311 are depicted by dotted lines at the positions turned by 45° about the center axis. Owing to this intermediate support section, the distances between all the adjacent corona discharge electrodes are kept constant. In addition, reference numerals 321 and 322 designate horizontal support arms, whose tip ends are bent in an L-shape and welded to the corona discharge electrodes 280 and 280', respectively. Through these horizontal support arms 321 and 322, all the corona discharge electrodes can be fixedly supported at their middle portions by means of a mechanism similar to that coupled to the support arms 274 and 275 in FIG. 16 while maintaining mutual inductance-insulation between the first corona discharge electrode group and the second corona discharge electrode group, and if necessary, mechanical impacts can be applied to the corona discharge electrodes via these horizontal support arms 321 and 322.

Now description will be made on a power supply apparatus to be used for the Boxer-Charger according to the present invention with reference to FIGS. 21 to 24.

At first, the principle of design of the power supply will be set forth. In FIG. 21, reference numerals 438 and 439, respectively, designate short pulse high voltage generators, and in the illustrated example, they consist of (1) high voltage coaxial cables 440 and 441 having their outer conductors grounded which are distributed parameter LC circuits serving as capacitive elements; (2) charging voltage sources 452 and 453 for charging these capacitive elements, consisting of a primary a.c. voltage source 417, step-up transformers 444 and 445 having the primary power supply connected to their primaries and their one secondary terminals 442 and 443 grounded, rectifiers 448 and 449 having directions of rectification directed in the same direction with respect to ungrounded terminals 446 and 447 of these transformers, and current-limiting resistors 450 and 451 connected to these rectifiers; (3) high-speed switch elements connected to the other ends of the capacitive elements, that is, spark gaps 454 and 455 in the illustrated example; and (4) leakage resistors for preventing accumulation of charge 436 and 437. Output terminals 456, 457, 458 and 459 of the short pulse high voltage generators 438 and 439 are connected via coupling capacitors 426, 427, 428 and 429 to respective pairs of lead wires 410–411 and 412–413, having leakage resistors for preventing accumulation of charge 434 and 435 connected in parallel between the coupling capacitors 426 and 427 and between the coupling capacitors 428 and 429. On the other hand, a main a.c. voltage source 414 consists of an a.c. primary voltage source 417 and a step-up main transformer 418, the secondary of the transformer is grounded at a neutral point 419, and the opposite ends of the secondary are connected via protective resistors 422 and 423 to the lead wires 411 and 413.

The above-described circuit can be used as a power supply for every type of Boxer-chargers according to the present invention. For instance, in the case of the Boxer-Chargers illustrated in FIGS. 8 to 11, the above-described lead wires 410, 411, 412 and 413 are connected to terminals 430, 431, 432 and 433, respectively, indicated in FIGS. 8 to 11.

In the example of circuit shown in FIG. 21, the connection between the secondaries of the step-up transformers 444 and 445 and the ground is made in opposite polarity to each other. As a result, the votage waveforms appearing at the secondary output terminals 446 and 447 have opposite polarities to each other with respect to the grounded terminals 442 and 443 as indicated at 460 and 461, respectively. Accordingly, during the period of the first half cycle of these waveforms, although the rectifier 448 becomes conducting and the cable 440 is charged at negative polarity, the other cable 441 cannot be charged because the rectifier 449 blocks a current. Therefore, when the waveform 460 takes a value near to its negative crest value, a spark is generated across the spark gap 454, resulting in a conducting state of the spark gap 454, so that the charged voltage on the cable 440 travels rightwards as a travelling wave negative pulse high voltage having a length of twice as long as the cable length, then passes through the coupling capacitors 426 and 427, and propagates as a traveling wave, for instance, through the gap space between the double helical corona discharge electrodes in the electrode assemblies **139*a* and 139*c* shown in FIG. 10. Hence, a streamer is generated in the gap space in a perfectly uniform manner, and so, strong and uniform two-dimensional plasma can be produced. At this moment, since the electrode assemblies 139*a* and 139*c* are applied with a negative main a.c. voltage with respect to the electrode assembly 139*b*, ample negative ions are supplied from the plasma on the electrode assemblies 139*a* and 139*c* into the charging spaces 108 and 109, respectively. Subsequently, during the period of the next half cycle of the waveforms 460 and 461, a pulse voltage is not generated on the side of the pulse generator 438 because the rectifier 448 blocks a current, but the other pulse generator 449 generates, in the neighborhood of the crest value, a travelling wave negative pulse high voltage similar to the above-described one, so that during this period, two-dimensional plasma consisting of a perfectly uniform streamer is produced between the double helical corona discharge electrodes of the electrode assembly 139***b* in FIG. 10 which is then held at negative polarity of the main a.c. voltage, and now negative ions are supplied from this electrode assembly 139*b* into the charging spaces 108 and 109.

In the above-described case, the cables 440 and 441 were used as one example of a capacitive element for generating a pulse having a very short pulse duration time. However, as a matter of course, besides, a capacitor 462 as shown in FIG. 22 or a combination of capacitors 463, 463', 463', . . . and inductors 464, 464', . . . in a ladder-type network as shown in FIG. 23 could be employed as the capacitive element. In addition, with regard to the switch elements 454 and 455, in place of the spark gaps, the so-called three-point spark gaps provided with a triggering electrode, spark gaps in which a spark is triggered by a laser beam, spark gaps sealingly enclosed within a pressurized inert gas or a pressurized $SF_6$ gas for increasing a switching speed, switching discharge tubes filled with a hydrogen gas, or the like could be employed. In addition, in place of the rectifiers 448 and 449, appropriate switching elements such as thyristors or the like could be used.

While the charging step-up transformers 444 and 445 in the pulse generator 438 and 439 were provided separately from the main step-up transformer 414 for generating a main a.c. voltage in the above-described embodiment, as a matter of course, modification could be made such that these transformers are formed in common, two intermediate taps are provided on the secondary winding of the main step-up transformer at the positions of equal number of turns as counted from the opposite ends, the output voltage between the opposite ends or between the two intermediate taps is used as a main a.c. voltage, and the voltages between the respective ends of the secondary winding and the nearest intermediate taps are respectively used as charging voltages for the pulse generators 438 and 439. In this case, owing to the fact that the step-up transformers in the charging voltage sources of the respective pulse generators share the same primary a.c. voltage source with the main transformer, the polarities of the respective secondary voltages for the pulse generators with respect to the rectifiers naturally become opposite to each other, and hence, the essential condition of the present invention can be naturally fulfilled.

FIG. 24 is a circuit diagram of such preferred embodiment of the power supply apparatus, in which on a secondary winding of a main transformer 465 connected to a primary a.c. voltage source 417 are provided intermediate tap terminals 468 and 469 at the positions of an appropriate number of turns as counted from the opposite end terminals 466 and 467, respectively, and the terminals 468 and 469 are connected via protective resistors 422 and 423 and lead wires 411 and 413 to one of the terminals of, for example, the respective electrode assemblies 139*a*, 139*b* and 139*c* in FIG. 10 to apply the main a.c. voltage between these electrode assemblies. Between said one terminal and the other terminal of the electrode assembly is connected a pulse generator 438 or 439, so that a pulse voltage having a very short pulse duration time may be alternately applied to thef gap space between the double helical corona discharge electrodes of the aforementioned electrode assemblies 139*a* and 139*c* or the electrode assembly 139*b*. The embodiment illustrated in FIG. 24 is economical because the coupling capacitors 426, 427, 428 and 429 and the step-up tranformers 444 and 445 become unnecessary.

What is claimed is:

1. A Boxer-Charger particle charging apparatus, in which a plurality of electrode assemblies each including at least one corona discharge electrode and consisting of electrode elements divided into two groups as insulated from each other so that adjacent electrode elements may belong to different groups, are disposed in an opposed relation to each other with a charging space placed therebetween, there is provided a main a.c. voltage source for applying a main a.c. voltage between opposed ones of said electrode assemblies to establish a main alternating electric field in said charging space placed between said opposed electrode assemblies, there are also provided excitation voltage sources for applying a pulse high voltage having a very short pulse duration time of 1 ns to 1 $\mu$s between said adjacent two groups of electrode elements belonging to said opposed electrode assemblies during a period contained within a half cycle of said main a.c. voltage when said opposed electrode assemblies alternately take particular polarity as synchronized with said main a.c. voltage, thereby corona discharge is generated on the corona discharge electrode when the electrode assemblies opposed to each other with said charging space placed therebetween alternately take said particular polarity of said main a.c. voltage, resulting in formation of a plasma ion source, then monopolar ions of said particular polarity are made to be emitted from the plasma ion source into said charging space and to travel across the charging space to the opposed electrode assembly of the opposite polarity, thus a current of monopolar ions which travel as alternately inverting the direction of current in synchronism with the main alternating electric field, is formed within the charging space to bombard particles to be charged which enter said charging space, from the opposite sides with said monopolar ions, and thereby the particles can be charged effectively and quickly.

2. A Boxer-Charger particle charging apparatus, in which a plurality of electrode assemblies each including at least one corona discharge electrode and consisting of electrode elements divided into two groups as insulated from each other so that adjacent electrode elements may belong to different groups, are disposed in an opposed relation to each other with a charging space placed therebetween, there is provided a main a.c. voltage source for applying a main a.c. voltage between opposed ones of said electrode assemblies to establish a main alternating electric field in said charging space placed between said opposed electrode assemblies, there are also provided excitation voltage sources for applying a pulse high voltage having a very short pulse duration time of 1 ns to 1 ms between said adjacent two groups of electrode elements belonging to said opposed electrode assemblies during a period contained within a half cycle of said main a.c. voltage when said opposed electrode assemblies alternately take particular polarity as synchronized with said main a.c. voltage, thereby corona discharge is generated on the corona discharge electrode when the electrode assemblies opposed to each other with said charging space placed therebetween alternately take said particular polarity of said main a.c. voltage, resulting in formation of a plasma ion source, then monopolar ions of said particular polarity are made to be emitted from the plasma ion source into said charging space and to travel across the charging space to the opposed electrode assembly of the opposite polarity, thus a current of monopolar ions which travel as alternately inverting the direction of current in synchronism with the main alternating electric field, is formed within the charging space to bombard particles to be charged which enter said charging space, from the opposite sides with said monopolar ions, and thereby the particles can be charged effectively and quickly; characterized in that said corona discharge electrode is formed in a helical form having a uniform pitch by means of a single elongated material.

3. A Boxer-Charger particle charging apparatus as claimed in claim 2, further characterized in that both of the two groups of electrode elements are formed in a double helical form having a uniform pitch and overlaid on the same cylindrical surface.

4. A Boxer-Charger particle charging apparatus as claimed in claim 3, further characterized in that both of said two groups of electrode elements are formed as coil springs.

5. A Boxer-Charger particle charging apparatus as claimed in claim 2, further characterized in that the corona discharge electrode is fixedly wound around an outer periphery of a cylindrical tubular body made of insulating material, the other electrode is used as a non-coronal electrode, and said non-coronal electrode is a conductor film formed along the inner peripheral surface of said cylindrical tubular body.

6. A Boxer-Charger particle charging apparatus, in which a plurality of electrode assemblies each including at least one corona discharge electrode and consisting of electrode elements divided into two groups as insulated from each other so that adjacent electrode elements may belong to different groups, are disposed in an opposed relation to each other with a charging space placed therebetween, there is provided a main a.c. voltage source for applying a main a.c. voltage between opposed ones of said electrode assemblies to establish a main alternating electric field in said charging space placed between said opposed electrode assemblies, there are also provided excitation voltage sources for applying a pulse high voltage having a very short pulse duration time of 1 ns to 1 ms between said adjacent two groups of electrode elements belonging to said opposed electrode assemblies during a period contained within a half cycle of said main a.c. voltage when said opposed electrode assemblies alternately take particular polarity as synchronized with said main a.c. voltage, thereby corona discharge is generated on the corona discharge electrode when the electrode assemblies opposed to each other with said charging space placed therebetween alternately take said particular polarity of said main a.c. voltage, resulting in formation of a plasma ion source, then monopolar ions of said particular polarity are made to be emitted from the plasma ion source into said charging space and to travel across the charging space to the opposed electrode assembly of the opposite polarity, thus a current of monopolar ions which travel as alternately inverting the direction of current in synchronism with the main alternating electric field, is formed within the charging space to bombard particles to be charged which enter said charging space, from the opposite sides with said monopolar ions, and thereby the particles can be charged effectively and quickly; characterized in that the groups of electrode elements in one said electrode assembly are disposed on a side surface of an imaginary tubular body having a cross-section shape of a closed loop or a polygon, in parallel to each other at equal intervals as insulated from each other, whereby an undesirable edge effect can be prevented.

7. A Boxer-Charger particle charging apparatus as claimed in claim 6, in which a plurality of said electrode assemblies are disposed in a single layer along a disposition plane adapted to intercept a path of the particles to be charged, in parallel to each other at an interval as jointed together while insulating adjacent electrode assemblies from each other.

8. A Boxer-Charger particle charging apparatus as claimed in claim 6, in which a plurality of said electrode assemblies are disposed in multiple layers along a disposition plane adapted to intercept a path of the particles to be charged, in parallel to each other at an equal interval as jointed together while insulating adjacent electrode assemblies from each other.

9. A Boxer-Charger particle charging apparatus as claimed in claim 6, 7 or 8, characterized in that the electrode elements of said electrode assembly are strip-shaped corona discharge electrodes disposed on a side surface of said imaginary tubular body in parallel to the generating lines at equal intervals while insulating adjacent ones from each other.

10. A particle charging apparatus, in which a plurality of electrode elements for establishing a main alternating electric field in a charging space and for effecting corona discharge, are provided so as to place said charging space therebetween, said apparatus includes excitation voltage sources for generating corona which selectively cause said electrode elements to effect corona discharge and a main voltage source for applying a main voltage to establish a main alternating electric field, thereby monopolar ions are selectively supplied from the respective electrode elements into the main alternating electric field as synchronized with said electric field to bombard and charge particles passing through the charging space with the monopolar ions alternately from the opposite directions, and said excitation voltage source for generating corona is formed as a pulse excitation voltage source adapted to produce a fast-rising pulse high voltage having a very short pulse duration time of 1 ns to 1 ms; characterized in that an inductance element is inserted between a group of electrode elements for establishing said main alternating electric field and a group of electrode elements for corona discharge, and thereby said respective electrode element groups are supported as inductance-insulated from each other.

11. A particle charging apparatus as claimed in claim 10, in which said electrode element groups consists of a pair of helical electrodes wound at equal intervals which jointly form a double helical electrode structure.

12. A particle charging apparatus as claimed in claim 11, in which a helical inductance element is provided continuously with one helical electrode in said double helical electrode structure.

13. A particle charging apparatus as claimed in claim 10, in which said electrode elements consist of strip-shaped electrodes disposed on a side surface of an imaginary tubular body at equal intervals as directed in the axial direction of the tubular body.

* * * * *

UNITED STATES PATENT AND TRADEMARK OFFICE

CERTIFICATE OF CORRECTION

PATENT NO. : 4,414,603

DATED : November 8, 1983

INVENTOR(S) : Senichi Masuda

It is certified that error appears in the above-identified patent and that said Letters Patent is hereby corrected as shown below:

Column 4, line 5:
"assembies" should be --assemblies--;

Column 5, line 10:
"21" should be --21b--;

Column 7, line 48:
"sources 9" should be --source 9--;

Column 10, line 41:
"Boxer-charger" should be --Boxer-Charger--;

Column 12, line 46:
"surface" should be --surfaces--;

Column 12, line 60:
after "103'b", insert -- -104'b--;

Column 13, line 10:
"cnsisting" should be --consisting--;

Column 13, line 61:
"pruducing" should be --producing--;

Column 14, line 11:
"115" should be --116--;

Column 15, line 62:
after "136'c)" insert --in parallel--;

Column 16, line 48:
"terminal 142" should be --terminals 142--;

UNITED STATES PATENT AND TRADEMARK OFFICE

CERTIFICATE OF CORRECTION

PATENT NO. : 4,414,603

DATED : November 8, 1983

INVENTOR(S) : Senichi Masuda

It is certified that error appears in the above-identified patent and that said Letters Patent is hereby corrected as shown below:

Column 20, lines 10-11:
"respectively" should be --respective--;

Column 21, line 28:
"237'" should be --237--;

Column 25, line 11:
"463'" (second occurrence) should be --463"--;

Column 25, line 64:
"thef" should be --the--.

Signed and Sealed this

*Twenty-fourth* Day of *April 1984*

[SEAL]

*Attest:*

GERALD J. MOSSINGHOFF

*Attesting Officer*

*Commissioner of Patents and Trademarks*